US007975826B2

(12) United States Patent
Kato et al.

(10) Patent No.: US 7,975,826 B2
(45) Date of Patent: Jul. 12, 2011

(54) STACKER AND CARD PROCESSING APPARATUS EQUIPPED WITH THE STACKER

(75) Inventors: Shigeru Kato, Kanagawa-ken (JP); Masato Mihara, Kanagawa-ken (JP)

(73) Assignee: Victor Company of Japan, Ltd., Yokohama (JP)

( * ) Notice: Subject to any disclaimer, the term of this patent is extended or adjusted under 35 U.S.C. 154(b) by 75 days.

(21) Appl. No.: 12/591,064

(22) Filed: Nov. 6, 2009

(65) Prior Publication Data

US 2010/0219579 A1 Sep. 2, 2010

(30) Foreign Application Priority Data

Feb. 27, 2009 (JP) ..... 2009-046011

(51) Int. Cl.
*B65H 31/34* (2006.01)

(52) U.S. Cl. ..... 193/46; 414/788.9

(58) Field of Classification Search ..... 193/44, 193/46, 47; 414/788.9, 789
See application file for complete search history.

(56) References Cited

U.S. PATENT DOCUMENTS

| | | | | |
|---|---|---|---|---|
| 2,461,290 | A * | 2/1949 | Di Giacomo et al. | 198/400 |
| 3,656,605 | A * | 4/1972 | Gess | 198/402 |
| 4,494,900 | A * | 1/1985 | Johnson et al. | 414/27 |
| 5,794,817 | A * | 8/1998 | Rosa | 221/281 |
| 6,602,043 | B2 * | 8/2003 | Honda | 414/801 |
| 6,634,485 | B1 * | 10/2003 | Cailbault | 198/417 |
| 6,968,763 | B2 * | 11/2005 | Chapin et al. | 83/164 |
| 2006/0124432 | A1 * | 6/2006 | Mercade et al. | 198/400 |

FOREIGN PATENT DOCUMENTS

| | | | |
|---|---|---|---|
| JP | 55093720 | A * | 7/1980 |
| JP | 2005-280954 | | 10/2005 |

* cited by examiner

*Primary Examiner* — Mark A Deuble
(74) *Attorney, Agent, or Firm* — Louis Woo

(57) ABSTRACT

A stacker is composed of a bottom plate, a containing section for storing a plurality of cards by stacking it on the bottom plate and a guiding section for guiding each card entering into the containing section. The guiding section is composed of a sidewall for restricting movement of an entering card when entering into the stacker in a first moving direction and a slanted section for slanting the card against the first moving direction. The slanted card moves in a second moving direction intersecting with the first moving direction at approximately a right angle by the gravitational force.

14 Claims, 17 Drawing Sheets

STACKER AND CARD PROCESSING APPARATUS EQUIPPED WITH THE STACKER

BACKGROUND OF THE INVENTION

1. Field of the Invention

This invention relates to a stacker and a card processing apparatus that is equipped with the stacker, particularly, relates to a stacker for containing a plurality of cards ejected from a card processing apparatus, which conducts secondary processing such as printing, laminating, magnetic processing and electrical processing with respect to each card, by stacking the plurality of cards in order, and the card processing apparatus equipped with the stacker.

2. Description of the Related Art

The Japanese publication of unexamined patent application No. 2005-280954 disclosed the conventional card stocker (hereinafter referred to as stacker). The stacker disclosed in the publication No. 2005-280954 stores a plurality of cards as goods to be stowed by stacking the cards.

More specifically, the stacker is installed nearby a card carrying out slot provided on a sidewall of a card printing apparatus as one example of a card processing apparatus, and stores a plurality of cards ejected from the card carrying out slot by stacking the cards as it is even though a front surface of a card is upside down when ejected from the card carrying out slot of the card printing apparatus.

As mentioned-above, the stacker disclosed in the publication No. 2005-28095 stacks a plurality of cards as it is. However, the stacker fails to be equipped with a component part for supporting a card ejected from the card carrying out slot. Therefore, a card freely falls in a space of the stacker immediately after the card is ejected from the card carrying out slot. As a result, falling posture of the card is hardly stabilized, so that a surface of a card is reversed in some cases.

Accordingly, it possibly occurs that cards stacked in the stacker are mixed with some cards of which surfaces are reversed with respect to others.

As mentioned-above, the stacker disclosed in the publication No. 2005-280954 exhibits a stacking problem of cards. Consequently, a stacker shown in FIG. 17 has been proposed so as to improve such a problem.

FIG. 17 is a perspective view of a stacker 105 and a card processing apparatus 101 according to the prior art. In FIG. 17, directions; upward (Up), downward (Down), leftward (Left), rightward (Right), frontward (Front) and backward (Back) are designated as a matter of practical convenience.

As shown in FIG. 17, a card carrying out slot 101*a* is provided on slightly higher position of a left sidewall 101*s* of the card processing apparatus 101. The stacker 105 is installed on the left side of the card processing apparatus 101 so as to be coincident with the card carrying out slot 101*a*, and stores a card Cd ejected from the card carrying out slot 101*a* by stacking the card Cd.

More specifically, the stacker 105 is provided with a slanted surface section 105*a* and a containing section 105*b*. The slanted surface section 105*a* is provided with a slanted surface, which is raised on the right end side toward the card carrying out slot 101*a* and gradually declines in accordance with the direction toward the left. The containing section 105*b* is formed in approximately a box shape and disposed outside of the slanted surface section 105*a* in a card carrying out direction of the card Cd or in the leftward direction.

By the above-mentioned structure of the stacker 105, the card Cd ejected from the card carrying out slot 101*a* slides down the slanted surface section 105*a* and falls in the containing section 105*b* in a box shape. The card Cd is held in the direction of gravitational force through the slanted surface section 105*a* while falling in the containing section 105*b*. Consequently, the card Cd falls in the containing section 105*a* in stable posture.

Accordingly, the card Cd is never reversed it surface while falling in the containing section 105*b* and all cards Cd are stacked while maintaining their surfaces in the same direction.

The stacker 105, however, is provided with the slanted surface section 105*a* and the containing section 105*b* in series along the card carrying out direction.

As shown in FIG. 17, a relatively large amount W5 of bulge exists in the left side of the card processing apparatus 101. In addition thereto, an extra space is necessary for taking out stacked cards from the containing section 105*b* on the left side of the stacker 105.

Accordingly, an installation space for the card processing apparatus 101 equipped with the stacker 105 results in extremely large area.

In order to improve efficiency of installation space of a card processing apparatus equipped with a stacker, it has been required for a card processing apparatus equipped with a stacker that the amount W5 of bulge should be decreased and the stacker should be compact in dimensions.

SUMMARY OF THE INVENTION

Accordingly, in consideration of the above-mentioned problems of the prior arts, an object of the present invention is to provide a stacker and a card processing apparatus equipped with the stacker. The stacker enables to store a plurality of cards by stacking the cards without reversing a surface of the card, and compacts in dimensions.

In order to achieve the above object, the present invention provides, according to an aspect thereof, a stacker comprising: a bottom plate; a containing section for storing a plurality of cards by stacking the plurality of cards on the bottom plate; and a guiding section for guiding each of the plurality of cards entering into the containing section from an external section provided above the bottom plate, the guiding section further comprising: a sidewall for restricting movement of an entering card by guiding a head of the entering card to contact with the sidewall when the card entering into the stacker in a first moving direction while the card maintaining approximately a horizontal posture; and a slanted section for supporting a bottom surface of either one of left and right sides of the card and for slanting another side of the card to be lowered with respect to the first moving direction of the card while the movement of the card is restricted by the sidewall, wherein the card slanted by the slanted section moves in a second moving direction intersecting with the first moving direction at approximately a right angle by the gravitational force and the card is guided into the containing section, and wherein the card guided into the containing section is stacked on the bottom plate.

According to another aspect of the present invention, there provided a stacker comprising: a bottom plate; a containing section for storing a plurality of cards by stacking the plurality of cards on the bottom plate; and a guiding section for guiding each of the plurality of cards entering into the containing section from an external section provided above the bottom plate, the guiding section further comprising: a sidewall for restricting movement of an entering card by guiding a head of the entering card to contact with the sidewall when the card entering into the stacker in a first moving direction while the card maintaining approximately a horizontal posture; a first slanted section for supporting a bottom surface of either one of left and right sides of the card and for slanting another side of the card to be lowered with respect to the first moving direction of the card while the movement of the card is restricted by the sidewall; and a second slanted section for guiding the card slanted by the first slanted section to move in a second moving direction intersecting with the first moving direction at approximately a right angle by the gravitational force while the bottom surface of the card contacts with the first slanted section, wherein the card is guided into the containing section through the second slanted section and stacked on the bottom plate.

According to a further aspect of the present invention, there provided a card processing apparatus for conducting an additional process to a card, the card processing apparatus comprising: a main body; a card carrying out slot provided on one sidewall of the main body for ejecting a card outside in a first moving direction; and a stacker having a containing section for storing the card sequentially ejected from the card carrying out slot by stacking the card, wherein the stacker further comprises a guiding section for moving the card ejected from the card carrying out slot in a second moving direction intersecting with the first moving direction at approximately a right angle by the gravitational force and for guiding the card into the containing section.

Other object and further features of the present invention will be apparent from the following detailed description when read in conjunction with the accompanying drawings.

DETAILED DESCRIPTION OF THE INVENTION

First Embodiment

In reference to FIGS. 1-7, a stacker and a card processing apparatus equipped with the stacker according to a first embodiment of the present invention is described in detail.

Figure 1:
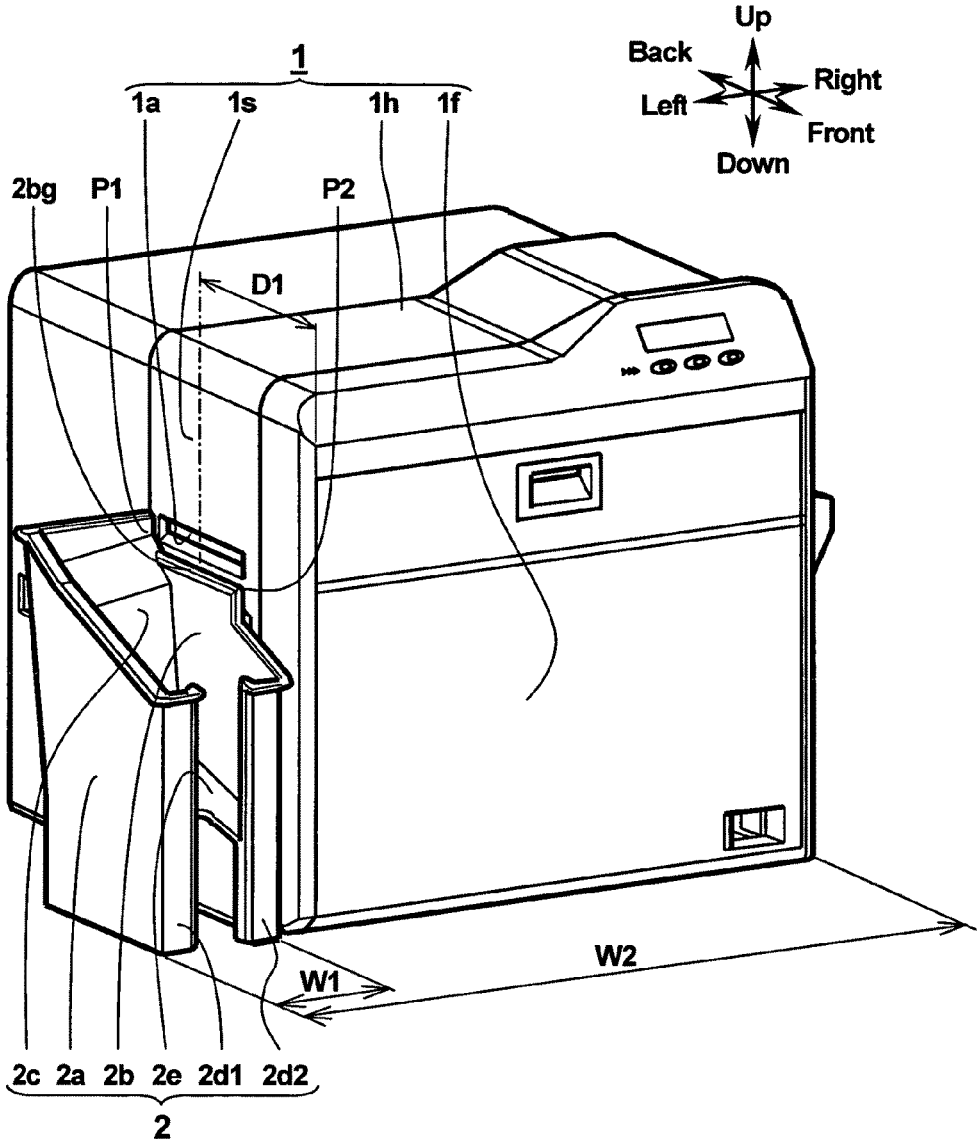
FIG. 1 is a perspective view of a stacker and a card processing apparatus equipped with the stacker according to a first embodiment of the present invention.

FIG. 1 is a perspective view of a stacker and a card processing apparatus equipped with the stacker according to a first embodiment of the present invention.

Figure 2:
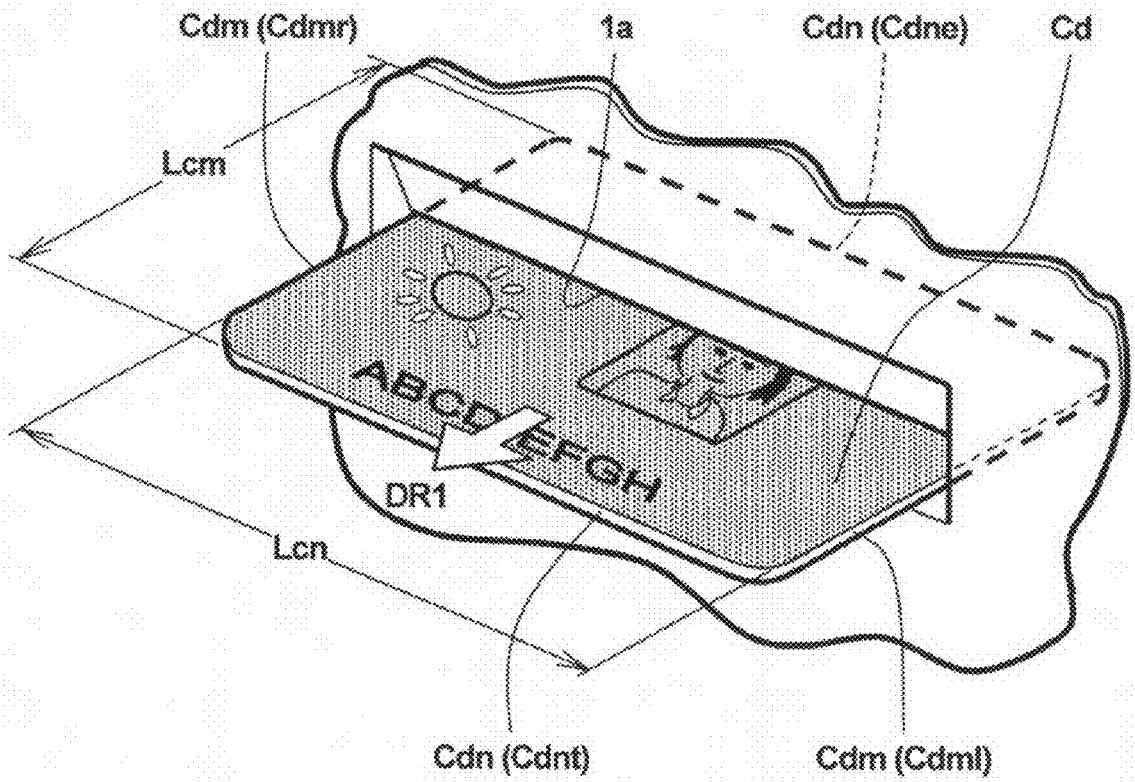
FIG. 2 is an explanatory drawing of a card carrying out slot of the card processing apparatus shown in FIG. 1 and a card ejected from the card carrying out slot.

FIG. 2 is an explanatory drawing of a card carrying out slot of the card processing apparatus shown in FIG. 1 and a card ejected from the card carrying out slot.

Figure 3:
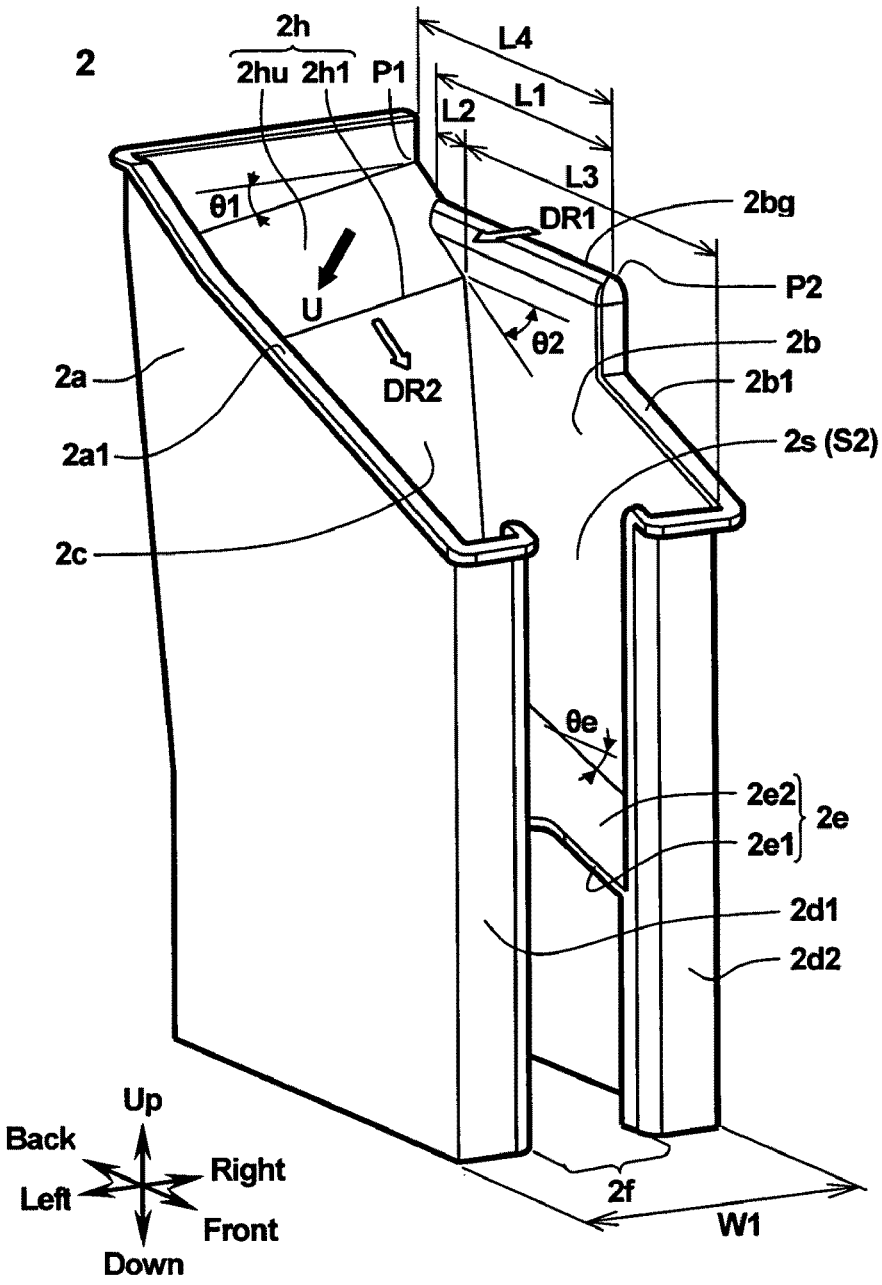
FIG. 3 is a detailed perspective view of the stacker shown in FIG. 1.

FIG. 3 is a detailed perspective view of the stacker shown in FIG. 1.

Figure 4:
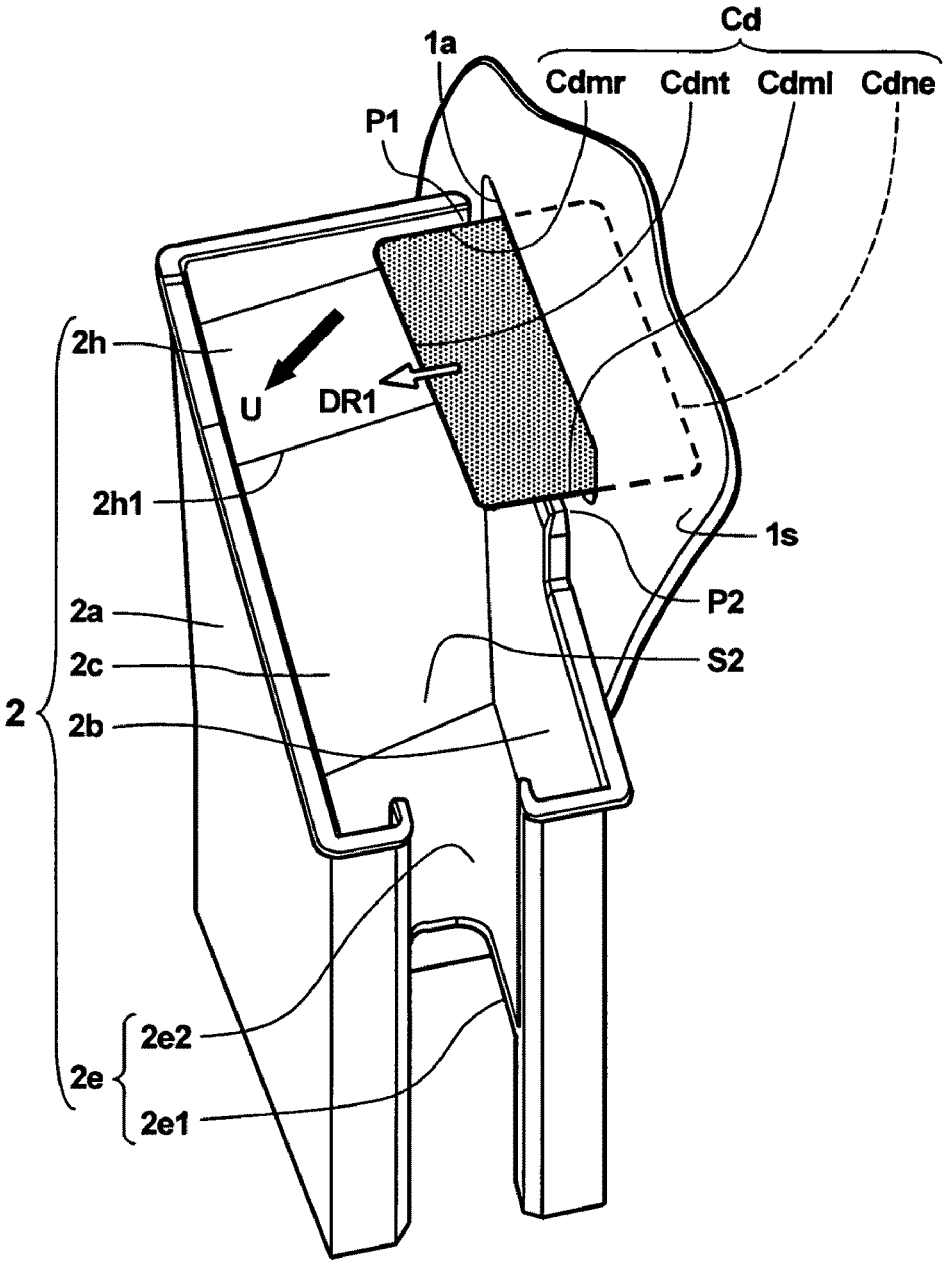
FIG. 4 is a detailed perspective view of the stacker shown in FIG. 1 exhibiting a first step of a process of storing a card in the stacker.

FIG. 4 is a detailed perspective view of the stacker shown in FIG. 1 exhibiting a first step of a process of storing a card in the stacker.

Figure 5:
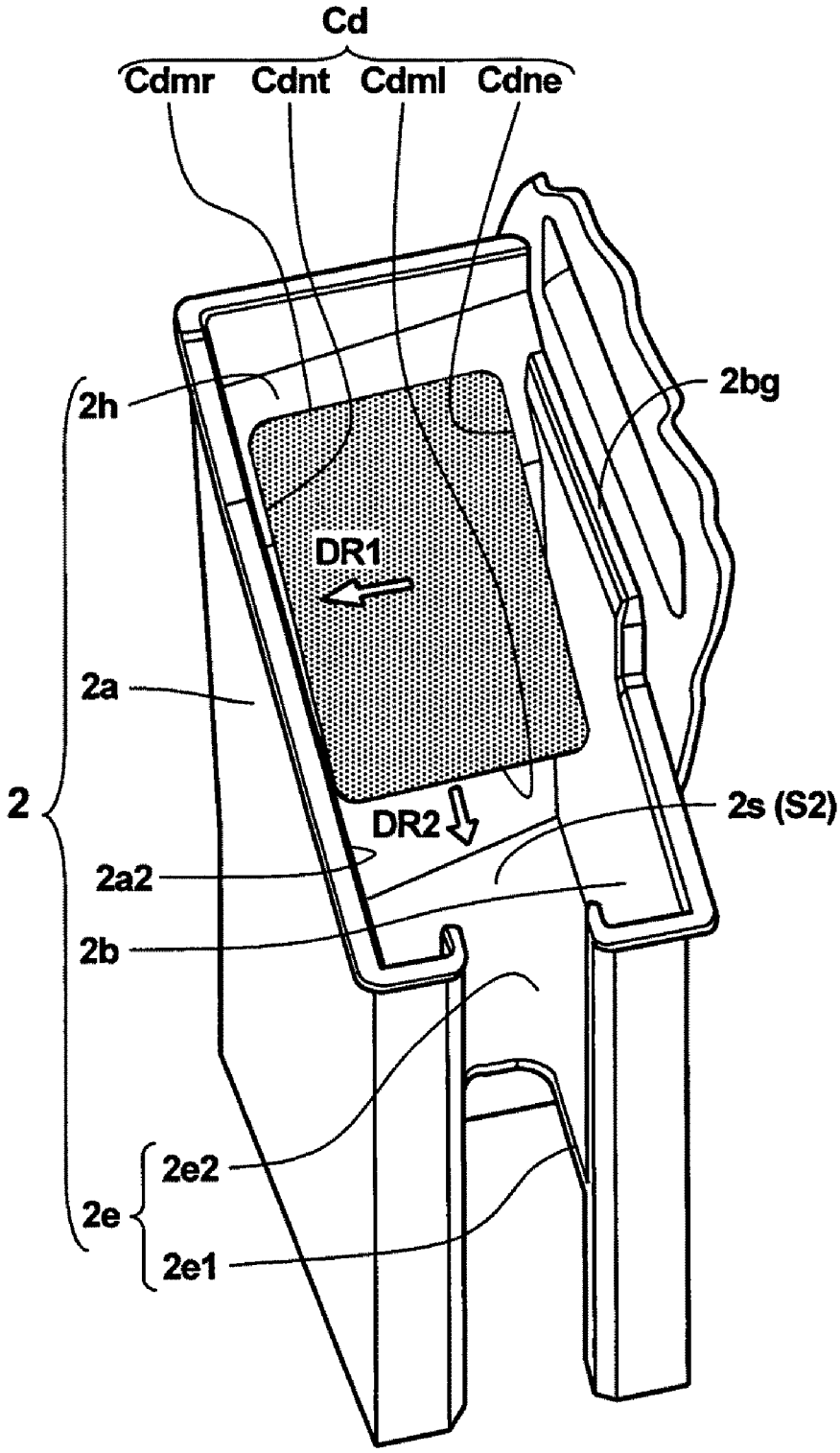
FIG. 5 is a detailed perspective view of the stacker shown in FIG. 1 exhibiting a second step of the process of storing the card in the stacker.

FIG. 5 is a detailed perspective view of the stacker shown in FIG. 1 exhibiting a second step of the process of storing the card in the stacker.

Figure 6:
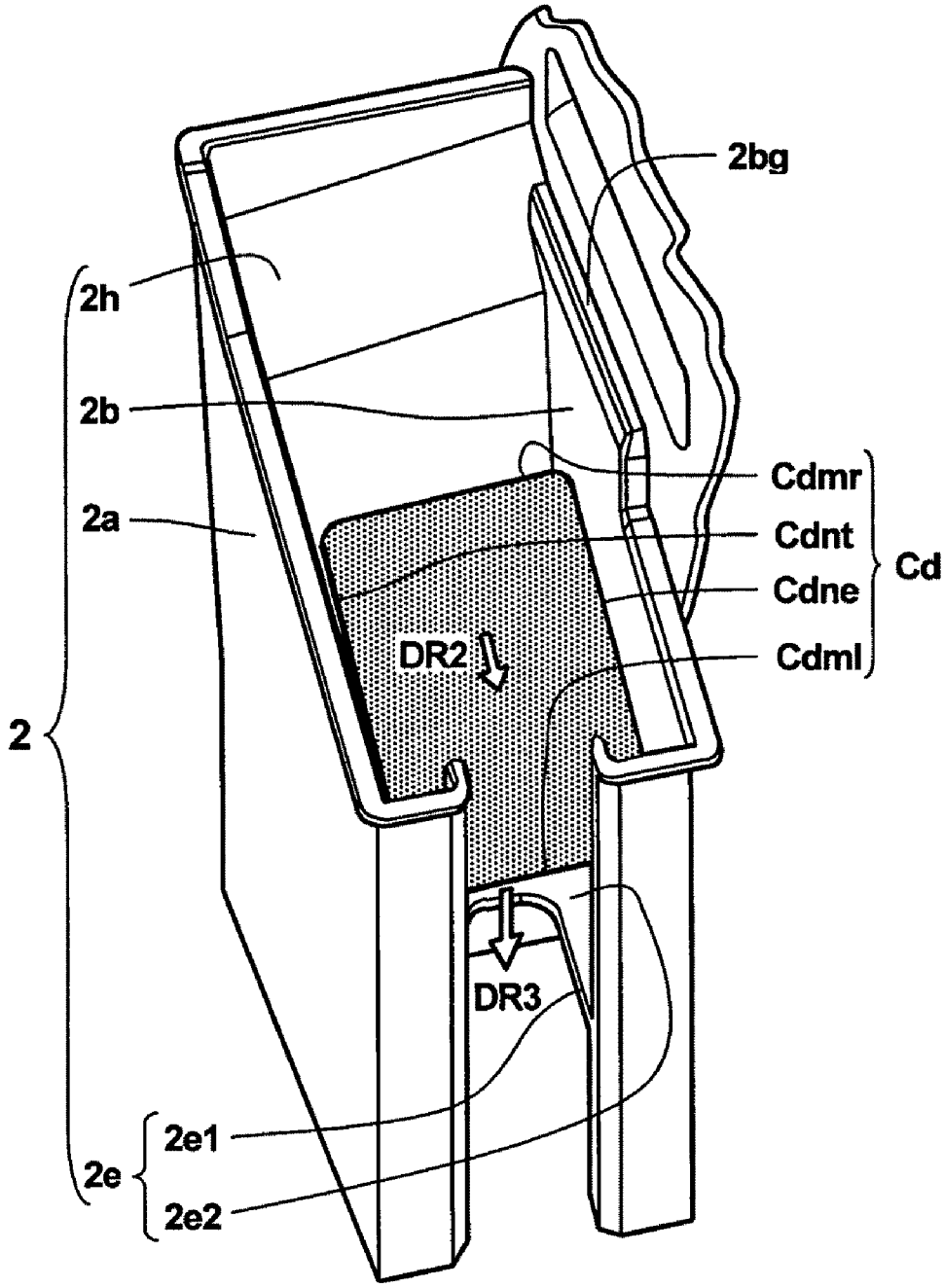
FIG. 6 is a detailed perspective view of the stacker shown in FIG. 1 exhibiting a third step of the process of storing the card in the stacker.

FIG. 6 is a detailed perspective view of the stacker shown in FIG. 1 exhibiting a third step of the process of storing the card in the stacker.

Figure 7:
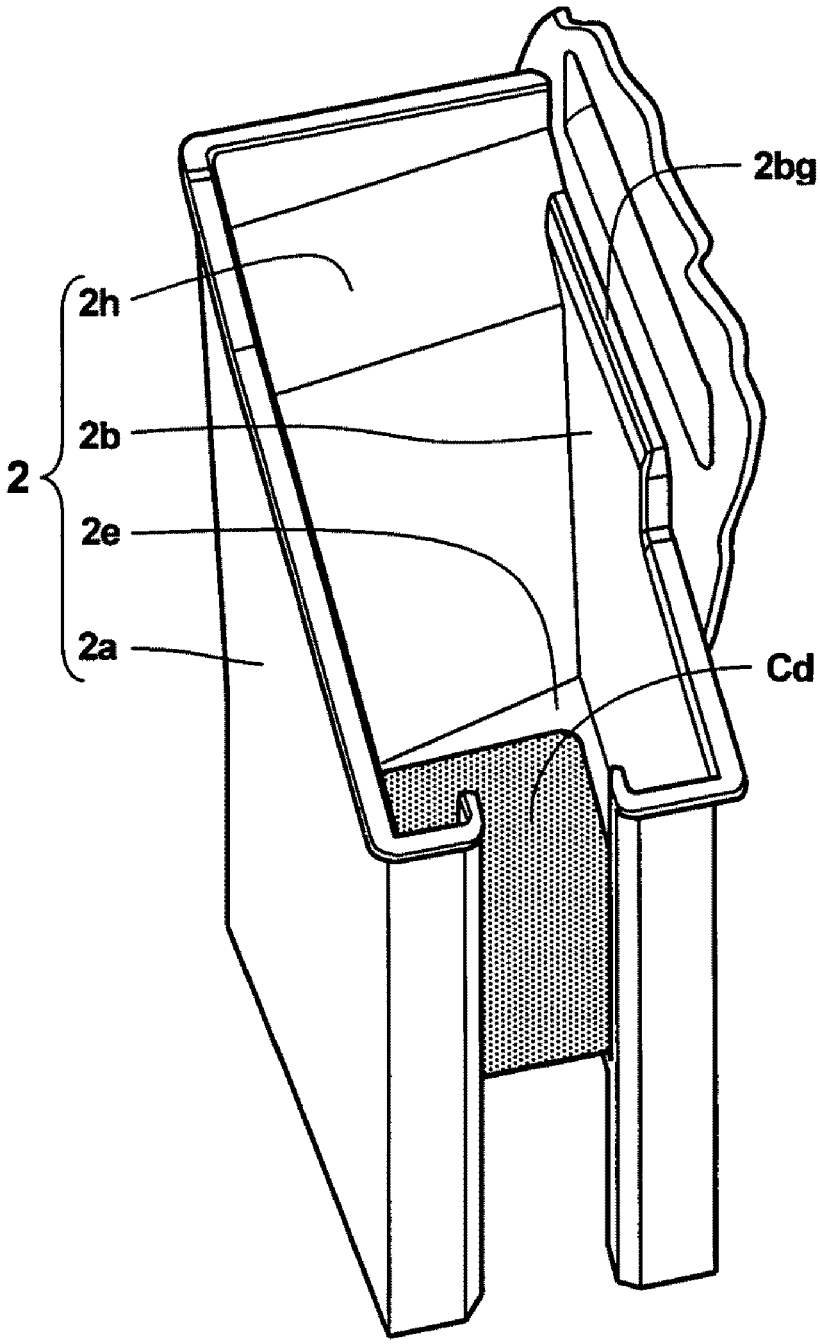
FIG. 7 is a detailed perspective view of the stacker shown in FIG. 1 exhibiting a fourth step of the process of storing the card in the stacker.

FIG. 7 is a detailed perspective view of the stacker shown in FIG. 1 exhibiting a fourth step of the process of storing the card in the stacker.

In FIG. 1, a stacker 2 stores a card as goods to be stowed. On the other hand, a card processing apparatus 1 is a card printer for conducting a printing process with respect to a card, and then the printed card is ejected from the card processing apparatus 1 through a card carrying out slot 1*a* into the stacker 2.

Further, the stacker 2 having a width of W1 is composed of a left wall section 2*a*, a right wall section 2*b*, a back wall section 2*c*, a pair of front walls 2*d*1 and 2*d*2 and a bottom wall section 2*e*.

Furthermore, the stacker 2 is provided with an ejection guiding section 2*bg*, a right back end portion P1 and a front end portion P2 of the ejection guiding section 2*bg*, which will be detailed later.

More, directions; upward (Up), downward (Down), leftward (Left), rightward (Right), frontward (Front) and backward (Back) are designated as a matter of practical convenience in FIGS. 1 and 3.

In addition thereto, the directions; Up, Down, Left, Right, Front and Back are also applied for each drawing of FIGS. 2 and 4-7 although the directions are not shown in respective drawings.

The card processing apparatus 1 is provided with the card carrying out slot 1*a* for ejecting a processed card. The card carrying out slot 1*a* is disposed on a left sidewall is of a main body 1*h* in a slightly higher position than middle. A center of the card carrying out slot 1*a* is disposed in a backward side of the left sidewall 1*s* by a distance of D1 from a front panel 1*f* of the card processing apparatus 1.

The stacker 2 is installed in the left side of the card processing apparatus 1.

Further, the stacker 2 is linked to the left sidewall 1*s* and integrated with the card processing apparatus 1 by a not shown linking device.

Furthermore, as shown in FIG. 1, a total width of the card processing apparatus 1 equipped with the stacker 2 is W2.

As shown in FIG. 2, a card Cd is formed in a rectangular shape having each pair of longitudinal sides Cdn and lateral sides Cdm.

In case a longitudinal length and a lateral length are defined as Lcn and Lcm respectively, actual dimensions of the card Cd, for example, are "Lcn=85.6 mm" and "Lcm=54.0 mm".

The card processing apparatus 1 conducts a process such as printing with respect to a card Cd, and then ejects the processed card Cd with heading one longitudinal side Cdn in a first ejecting direction shown by an arrow DR1 through the card carrying out slot 1*a*.

Hereupon, a reference sign is given to each side of the card Cd. A longitudinal side Cdn to be headed when ejected from the card carrying out slot 1*a* is defined as "Cdnt". Another longitudinal side Cdn to be a tail is defined as "Cdne". A lateral side Cdm in the right side of the first ejecting direction DR1 or in the back side of the card processing apparatus 1 is defined as "Cdmr". Another lateral side Cdm in the left side of the first ejecting direction DR1 or in the front side of the card processing apparatus 1 is defined as "Cdml".

As shown in FIG. 3, the stacker 2 is provided with a plurality of wall sections that extends vertically and formed in approximately a box shape that enables to contain goods to be stowed in a space S2 surrounded by each wall section.

The stacker 2 is formed by the injection molding method of resin, for example. A typical material of resin is an acrylic resin. Particularly, in case the stacker 2 is formed transparently by using a polymethylmethacrylate (PMMA) resin, its appearance is excellent.

More specifically, as shown in FIG. 3, the stacker 2 is formed by the left wall section 2*a* and the right wall section 2*b*, which confront with each other as a pair of sidewalls and extend vertically, the back wall section 2*c*, which connects the left wall section 2*a* to the right wall section 2*b* on the back side of the stacker 2, the pair of front walls 2*d*1 and 2*d*2, which extend in a direction of approaching each other on each front side of the left wall section 2*a* and the right wall section 2*b*, and the bottom wall section 2*e*. The bottom wall section 2*e* is a bottom plate connected to each of the wall sections 2*a*, 2*b*, 2*c*, 2*d*1, and 2*d*2. A top surface 2*e*2 of the bottom wall section 2*e* is slanted such that its front side is lowered with respect to its back side.

A distance between the left and right wall sections 2*a* and 2*b* is set to be slightly larger than the lateral length Lcm of the card Cd to be stowed.

A slit 2*f* is formed between the pair of front wall sections 2*d*1 and 2*d*2. A cutout section 2*e*1 having an opening width corresponding to the slit 2*f* is formed on the bottom wall section 2*e*. The cutout section 2*e*1 is a cutout for inserting a finger tip under piled cards Cd when taking out the piled cards Cd contained in the space S2 of the stacker 2 by hand.

Each wall section of the left 2*a*, the right 2*b*, the back 2*c*, the pair of front 2*d*1 and 2*d*2, and the bottom 2*e* forms a containing section 2*s*.

Further, the space S2 or the containing section 2*s* surrounded by the wall sections 2*a*, 2*b*, 2*c*, 2*d*1, 2*d*2 and 2*e* is a containing space for containing a plurality of cards Cd by stacking the cards Cd on the bottom wall section 2*e*.

A top end section 2*a*1 of the let wall section 2*a* is formed so as to be gradually slanted such that a front portion of the top end section 2*a*1 is lower than a back portion. An angle of gradient of the top end section 2*a*1 is set to be approximately the same as a third angle θe of gradient of the bottom wall section 2*e*.

On the other hand, a top end section 2*b*1 of the right wall section 2*b* is provided with the ejection guiding section 2*bg* having a length L1 that is formed horizontally. The length L1 is set to be slightly shorter than the longitudinal length Lcn of the card Cd.

Further, a front portion of the top end section 2*b*1 of the right wall section 2*b* is formed so as to be gradually slanted such that an angle of gradient of the top end section 2*b*1 is set to be approximately the same as the third angle θe of gradient of the bottom wall section 2*e* and a height of the front portion of the top end section 2*b*1 is the same as a height of a front portion of the top end section 2*a*1 of the left wall section 2*a*.

A slanted surface section 2*h* is provided on an upper side of the back wall section 2*c*. A top surface 2*hu* of the slanted surface section 2*h* is formed as a slanted surface that is slanted so as to decline in accordance with a direction from right to left along the first ejecting direction DR1.

Further, the top surface 2*hu* is also formed as a slanted surface that is slanted so as to decline in accordance with approaching the front walls 2*d*1 and 2*d*2 along a second ejecting direction DR2 to be detailed.

Furthermore, a slanting direction of the top surface 2*hu* of the slanted surface section 2*h* is an arrow "U" direction as shown in FIG. 3.

More, the top surface 2*hu* is slanted such that a right back side of the top surface 2*hu* is the highest portion and a left front side is the lowest portion.

Moreover, a distance L4 between the right back end portion P1 of the slanted surface section 2*h* and the front end portion P2 of the ejection guiding section 2*bg* is set to be approximately the same as a width of the card carrying out slot 1*a* of the cad processing apparatus 1.

The stacker 2 is installed such that a range from the right back portion P1 to the front end portion P2 is disposed right under the card carrying out slot 1*a* of the card processing apparatus 1 as shown in FIG. 1.

Further, a position of a front side edge section 2*h*1 of the slanted surface section 2*h*, that is, a position of a ridge line of the slanted surface section 2*h* intersecting with the back wall section 2*c* is shifted frontward from a back end portion of the ejection guiding section 2*bg* by a distance L2. The distance L2 is set to be 20 mm hereupon.

Furthermore, a typical angle of gradient of the top surface 2*hu* of the slanted surface section 2*h* is as follows: a first angle θ1 of gradient of the top surface 2*hu* in the first ejecting direction DR1 is a range from 10 to 20 degrees, and a second angle θ2 of gradient in the second ejecting direction DR2 is a rage from 20 to 40 degrees.

In reference to FIGS. 4-7, a process of storing a card Cd in the stacker 2 is described in detail next.

As shown in FIGS. 1 and 3, the right wall section 2*b* of the stacker 2 is installed on the left sidewall 1*s* of the card processing apparatus 1. In this condition, the range from the right back portion P1 to the front end portion P2 including the ejection guiding section 2*bg* is disposed right under the card carrying out slot 1*a*.

FIG. 4 shows an intermediate state of the card Cd ejected from the card carrying out slot 1*a*. The card Cd is ejected from the card carrying out slot 1*a* in the arrow DR1 direction (first ejecting direction) while the longitudinal side of the card Cd is aligned in parallel with the left sidewall section 1*s* of the card processing apparatus 1. In other words, the card Cd is ejected from the card carrying out slot 1*a* while the longitudinal side Cdnt is headed.

As mentioned above, the stacker 2 is installed on the left side of the card processing apparatus 1 such that the range from the right back portion P1 to the front end portion P2 is disposed right under the card carrying out slot 1*a*.

Further, as shown in FIG. 3, the front side edge section 2*h*1 of the slanted surface section 2*h* is shifted frontward from the back end portion of the ejection guiding section 2*bg* by the distance L2. Consequently, the card Cd ejected form the card carrying out slot 1*a* is firstly supported by the ejection guiding section 2*bg* from a bottom side, and secondly the longitudinal side Cdnt of the card Cd as a head end edge is placed on the slanted surface section 2*h* in accordance with progress of ejecting the card Cd.

Then, as shown in FIG. 5, the head end edge of the longitudinal side Cdnt of the card Cd contacts with an inner wall surface 2*a*2 of the left sidewall section 2*a* when the other longitudinal side Cdne as a tail end edge of the card Cd passes over the ejection guiding section 2*bg*.

Further, as mentioned above, the top surface 2*hu* of the slanted surface section 2*h* is slanted in the arrow "U" direction, so that the lateral side Cdml of the card Cd is slanted to be lowered, and then the card Cd slides down in the second ejecting direction DR2 by the gravitational force.

Furthermore, the left wall section 2*a* is formed such that a portion of the left wall section 2*a* at which the card Cd contacts and its neighboring area expand within a plane intersecting with the first ejecting direction DR1 at approximately a right angle. Therefore, an ejecting direction of the card Cd is changed from the arrow DR1 direction to the arrow DR2 direction. In other words, the ejecting direction of the card Cd is turned counterclockwise by 90 degrees viewing from up above the stacker 2.

FIG. 6 shows an intermediate state of the card Cd falling down into the space S2 of the stacker 2. In FIG. 6, the card Cd falls toward the bottom wall section 2*e* in an arrow DR3 direction.

FIG. 7 shows a final state of the card Cd landed on the bottom wall section 2*e*. In FIG. 7, the card Cd is a first one of cards to be stacked. Cards succeeding the first one are sequentially stacked on a previously stacked card through the above-mentioned storing processes shown in FIGS. 4-7.

Referring back to FIGS. 5 and 6, a posture of the card Cd while sliding down in the arrow DR2 direction or the second ejecting direction DR2 is such that movement of the card Cd from the card carrying out slot 1*a* is restricted by the inner wall surface 2*a*2 of the left wall section 2*a*.

Further, the position of the longitudinal side Cdnt to be a head of the card Cd when ejected from the card carrying out slot 1*a* is also determined by inner wall surface 2*a*2 of the left wall section 2*a*.

Furthermore, with respect to a direction of the gravitational force, the lateral side Cdmr on the back side of the card Cd is supported by the slanted surface section 2*h* when sliding down in the arrow DR2 direction, so that the posture of the card Cd is maintained extremely stable.

Accordingly, the card Cd is never reversed its surface while sliding down into the space S2.

In addition, the card Cd is stacked on the bottom wall section 2*e* almost without positional deflection in a left and right direction.

By the above-mentioned configuration of the stacker 2, the ejecting direction of the card Cd is changed from the arrow DR1 direction (first ejecting direction) to the arrow DR2 direction (second ejecting direction), so that the width W1 of the stacker 2 shown in FIG. 1 or 3 enables to be shortened as narrow as a dimension of the lateral length Lcm of the card Cd added with thicknesses of the left and right wall sections 2*a* and 2*b*. Therefore the stacker 2 is extremely compact in width.

As a result, the total width W2 of the card processing apparatus 1 equipped with the stacker 2 shown in FIG. 1 is also small in dimension.

Accordingly, the card processing apparatus 1 equipped with the stacker 2 enables to be installed even in a narrower space than ever Further, as shown in FIG. 1, a position of outer surfaces of the front wall sections 2*d*1 and 2*d*2 toward the front side is designated so as to be approximately the same position as the front surface 1*f* of the card processing apparatus 1.

Furthermore, in FIG. 3, a distance L3 between the back wall section 2*c* and the front wall sections 2*d*1 and 2*d*2 is set to be slightly larger than the longitudinal length Lcn of the card Cd.

By the above-mentioned configuration of the stacker 2, a plurality of cards Cd contained in the stacker 2 enables to be taken out from the front side, and resulting in extremely easy handling of the stacked cards Cd even though the card carrying out slot 1*a* is set far back from the front surface 1*f* of the card processing apparatus 1 by the distance D1 as shown in FIG. 1.

Further, positional deflection of the cards Cd stacked in the containing section 2*s* is restricted excellently.

Furthermore, in FIG. 3, the third angle θe of gradient of the top surface 2*e*2 on which the card Cd is stacked, of the bottom wall section 2*e* in a front-back direction is preferable to be the same angle as the second angle θ2 of gradient of the slanted surface section 2*h*.

More, an angle of gradient of the top surface 2*e*2 in the left and right direction is also preferable to be the same angle as the first angle θ1 of gradient of the slanted surface section 2*h*.

Moreover, the top surface 2*e*2 of the bottom wall section 2*e* is desirable to be formed in parallel with the top surface 2*hu* of the slanted surface section 2*h*.

By the above-mentioned configuration of the bottom wall section 2*e*, a posture of the card Cd landed on the top surface 2*e*2 of the bottom wall section 2*e* or stacked on a card previously landed on the top surface 2*e*2 approximately coincides with the posture of the card Cd at the beginning of falling down, and resulting in suppressing bounce of the card Cd when landed on the top surface 2*e*2 of the bottom wall section 2*e*.

Accordingly, a posture of the card Cd in the containing section 2*s* is always maintained in stable condition and the cards Cd enable to be contained in order.

In addition, the card Cd enables to be securely prevented from accidental error of containing more.

Second Embodiment

In reference to FIGS. 8-16, another stacker according to a second embodiment of the present invention is described in detail next.

Figure 8:
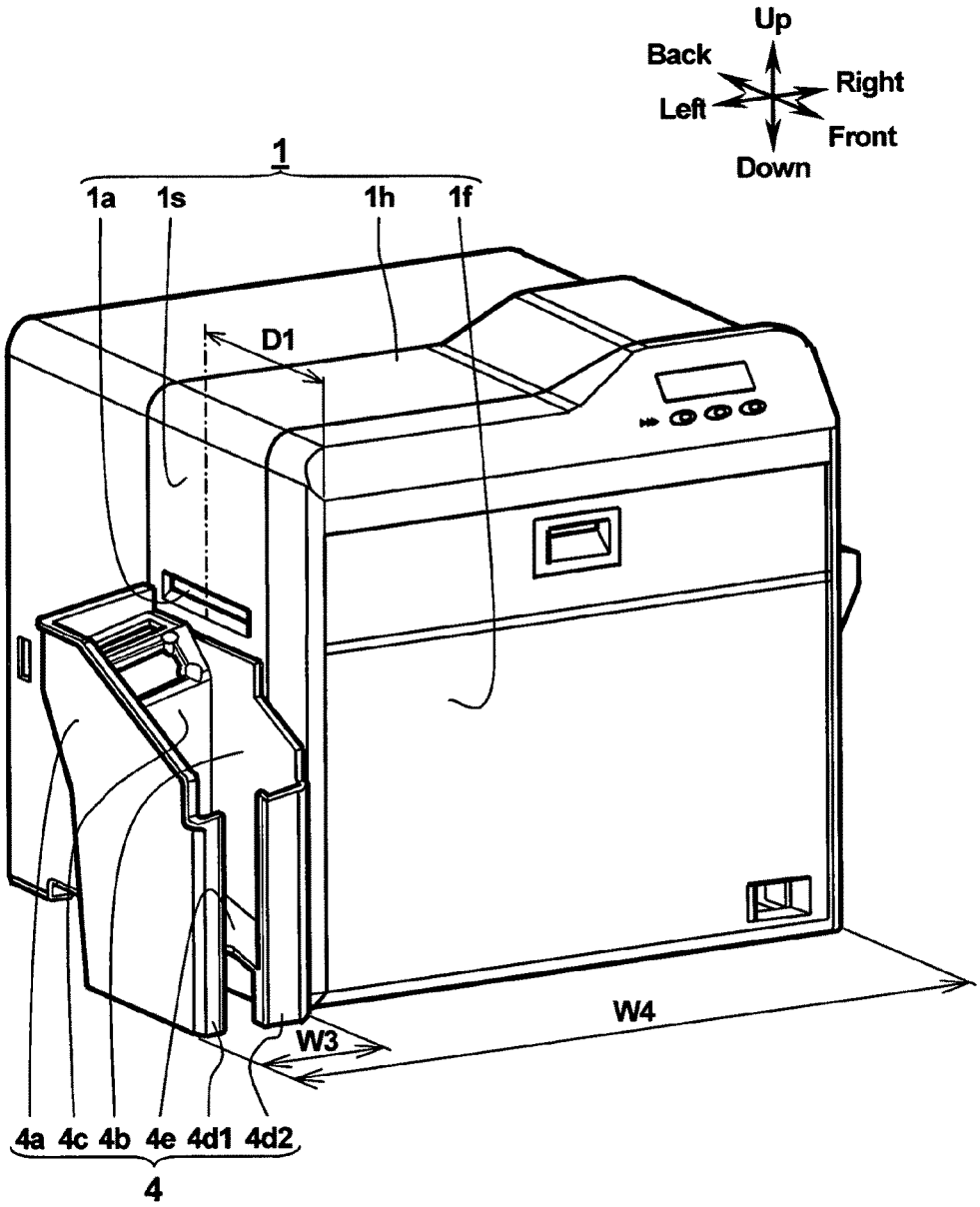
FIG. 8 is a perspective view of a stacker and a card processing apparatus equipped with the stacker according to a second embodiment of the present invention.

FIG. 8 is a perspective view of a stacker and a card processing apparatus equipped with the stacker according to a second embodiment of the present invention. In FIG. 8, a card processing apparatus 1 according to the second embodiment of the present invention is the same as the card processing apparatus 1 according to the first embodiment, so that some descriptions in the first embodiment are duplicated in the second embodiment.

Figure 9:
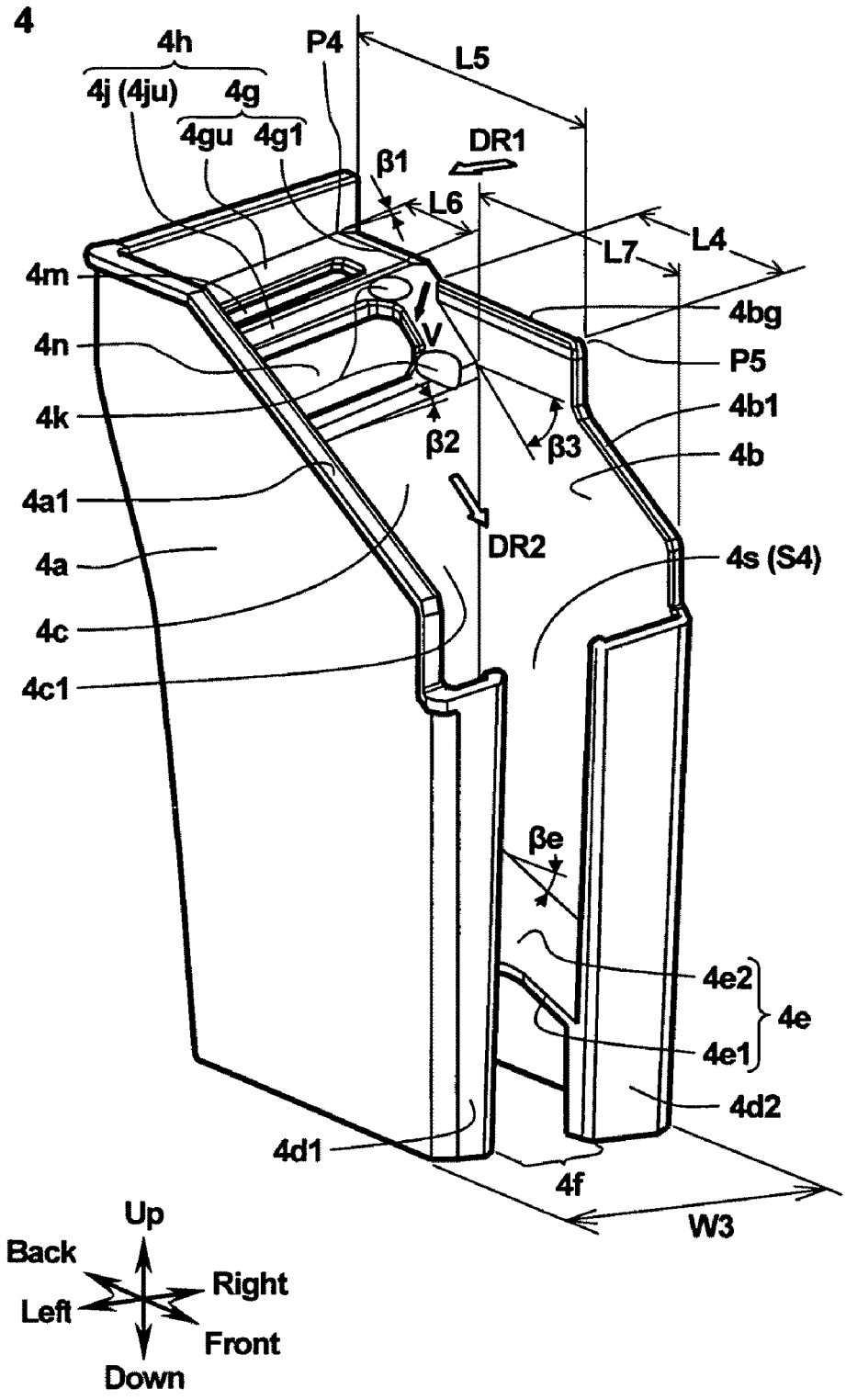
FIG. 9 is a detailed perspective view of the stacker shown in FIG. 8.

FIG. 9 is a detailed perspective view of the stacker shown in FIG. 8.

Figure 10:
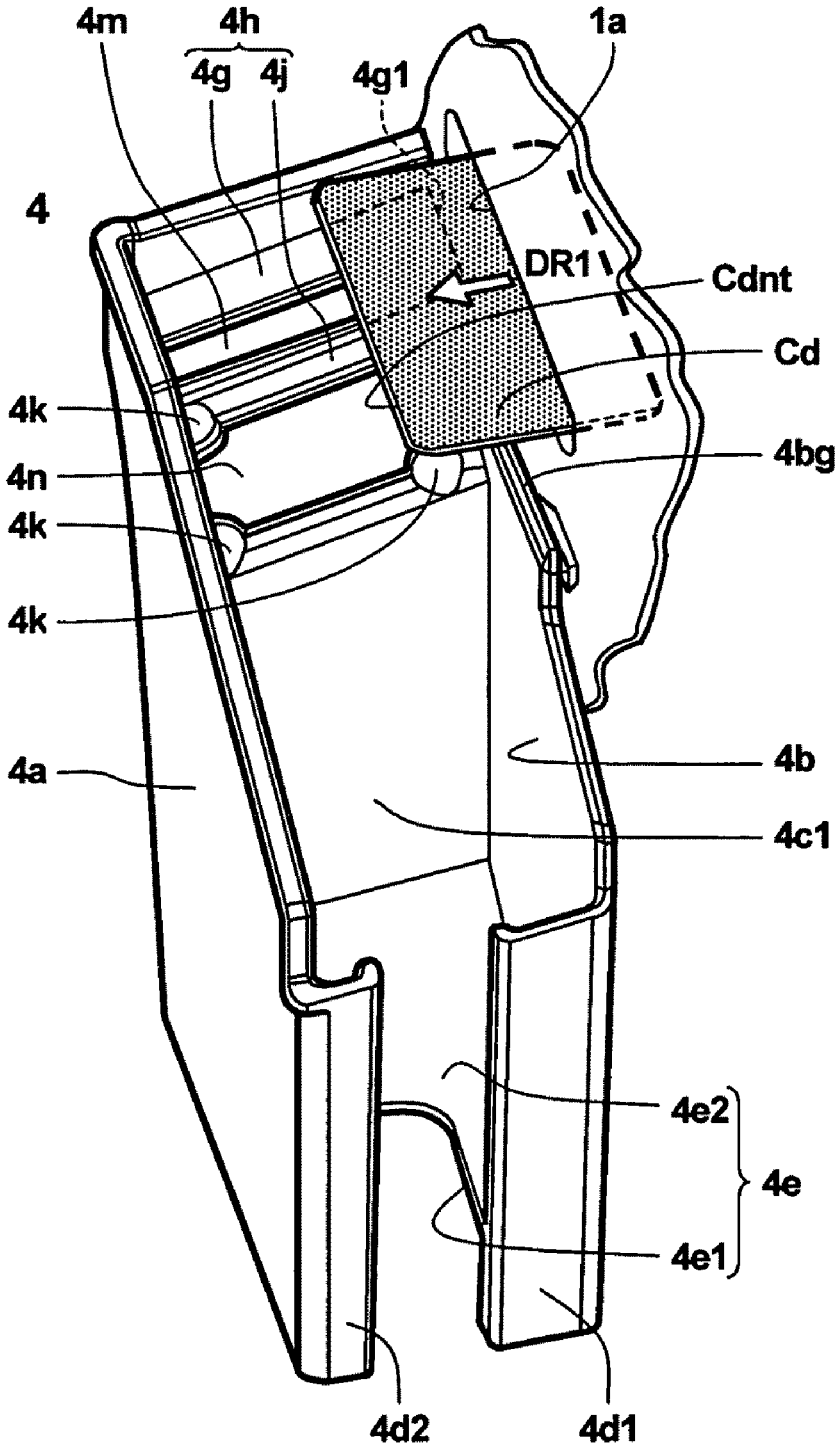
FIG. 10 is a detailed perspective view of the stacker shown in FIG. 8 exhibiting a first step of a process of storing a card in the stacker.

FIG. 10 is a detailed perspective view of the stacker shown in FIG. 8 exhibiting a first step of a process of storing a card in the stacker.

Figure 11:
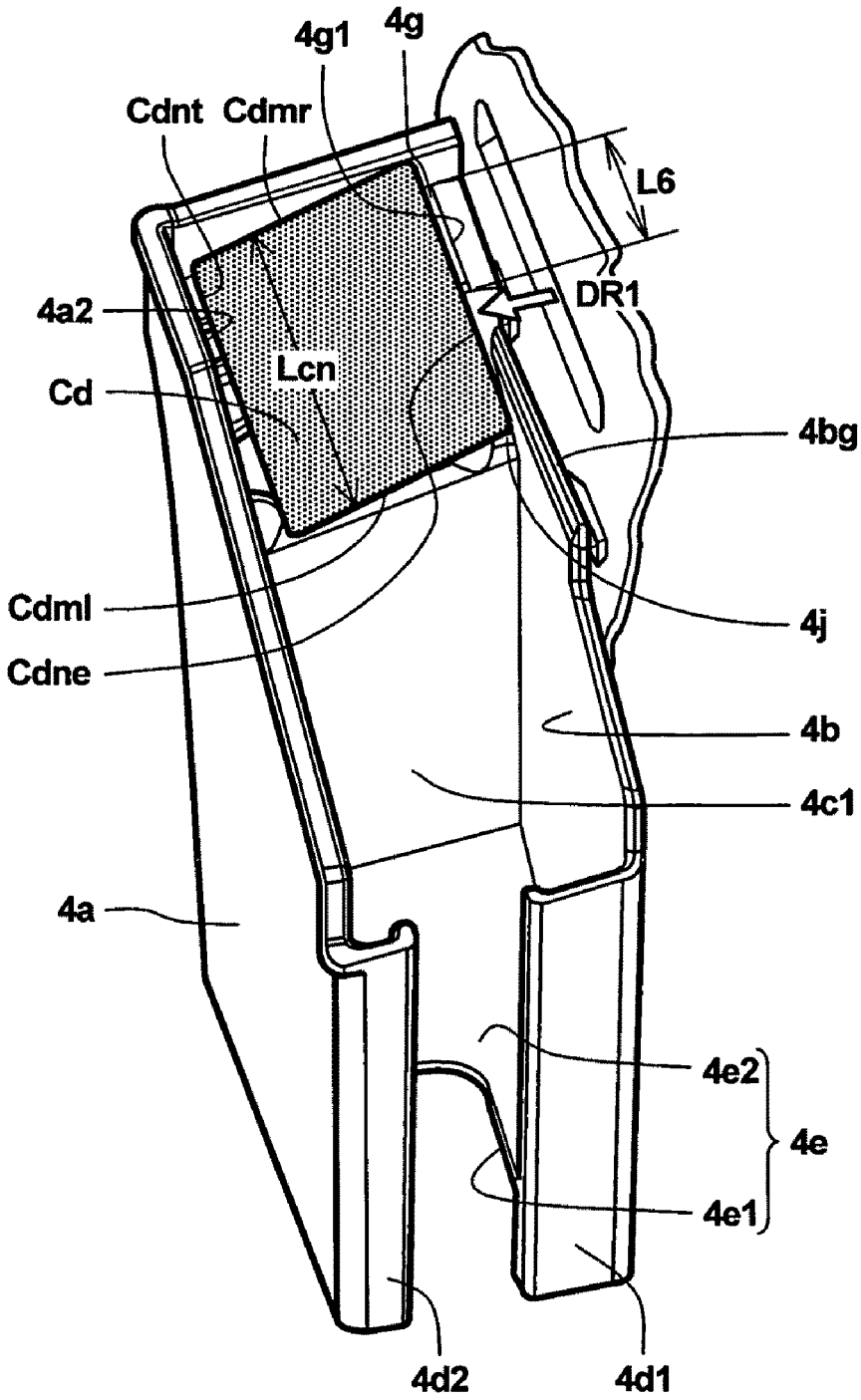
FIG. 11 is a detailed perspective view of the stacker shown in FIG. 8 exhibiting a second step of the process of storing the card in the stacker.

FIG. 11 is a detailed perspective view of the stacker shown in FIG. 8 exhibiting a second step of the process of storing the card in the stacker.

Figure 12:
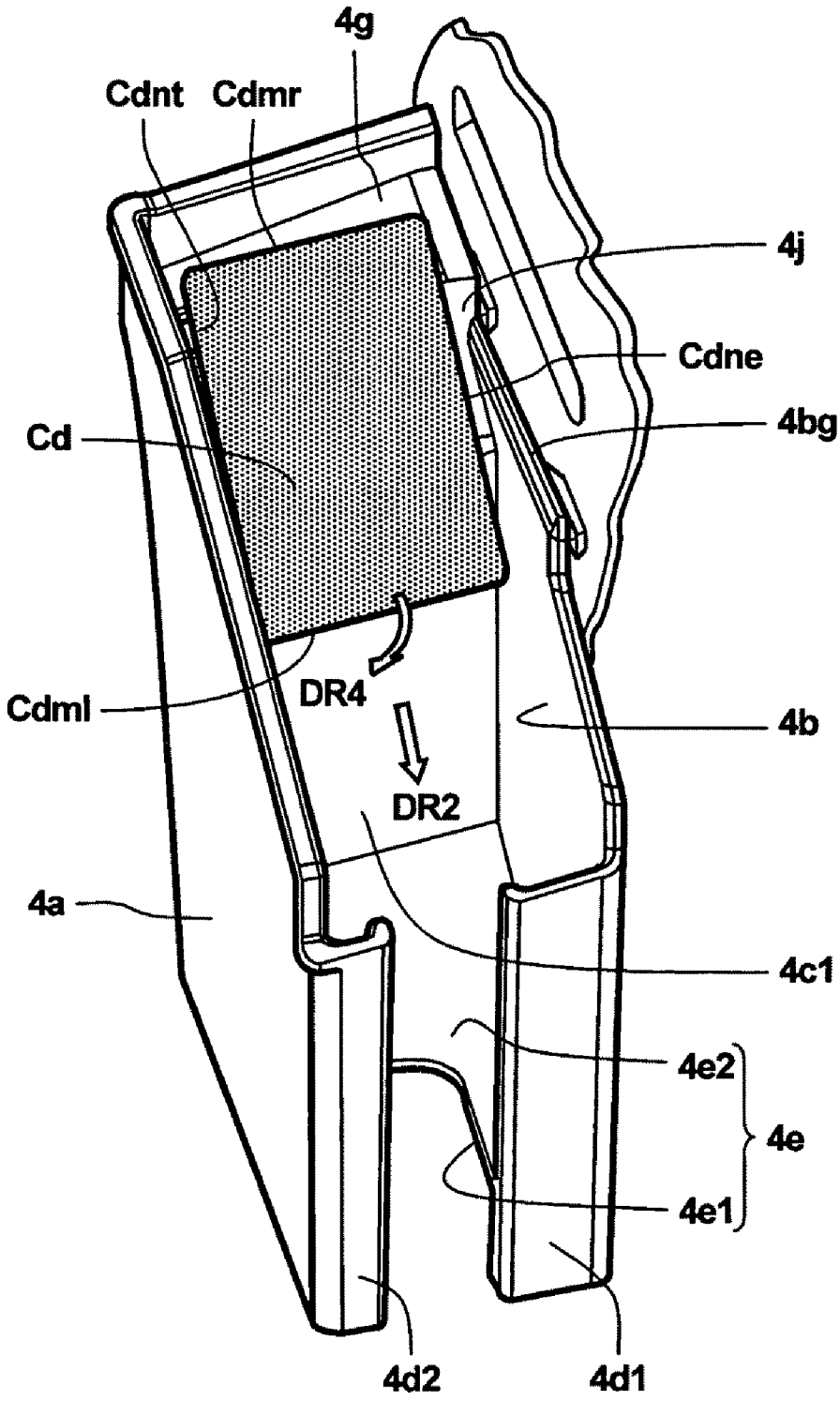
FIG. 12 is a detailed perspective view of the stacker shown in FIG. 8 exhibiting a third step of the process of storing the card in the stacker.

FIG. 12 is a detailed perspective view of the stacker shown in FIG. 8 exhibiting a third step of the process of storing the card in the stacker.

Figure 13:
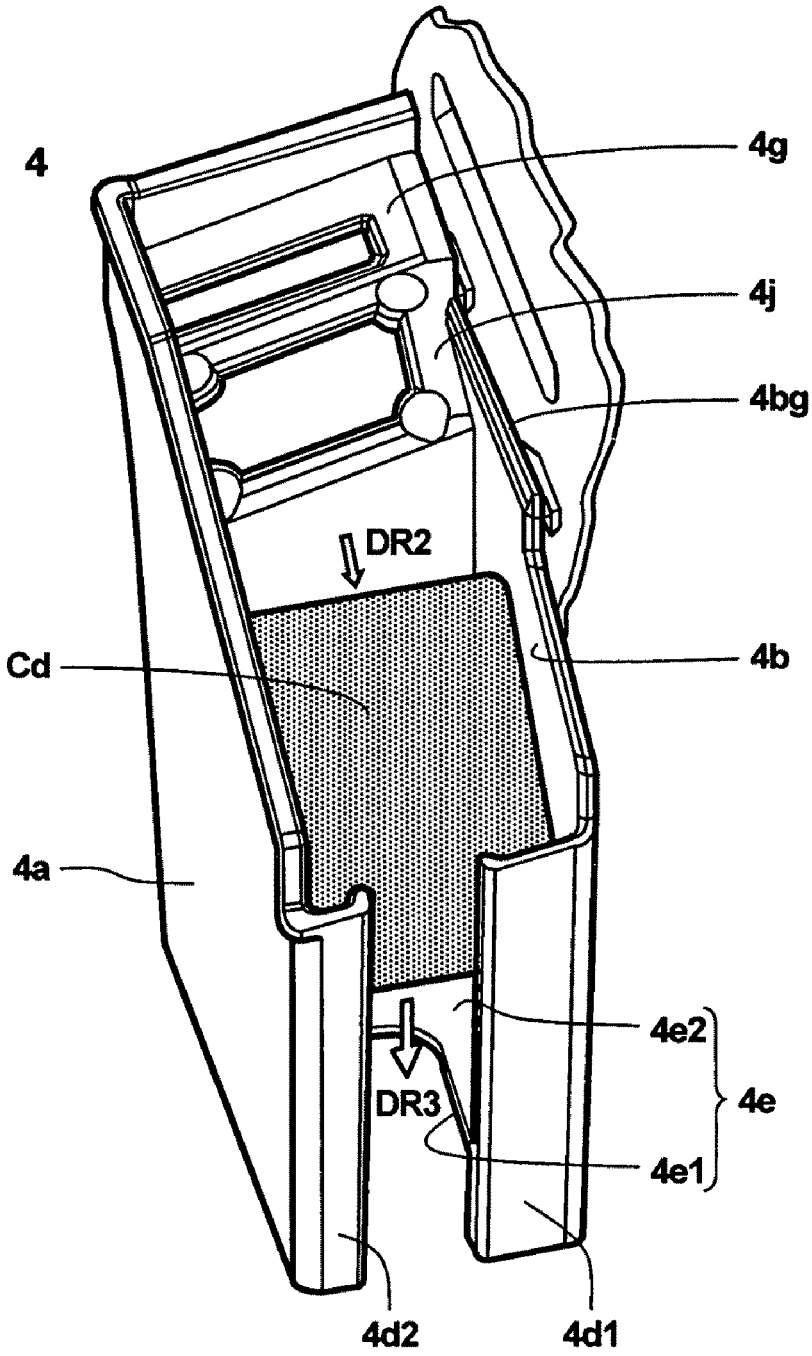
FIG. 13 is a detailed perspective view of the stacker shown in FIG. 8 exhibiting a fourth step of the process of storing the card in the stacker.

FIG. 13 is a detailed perspective view of the stacker shown in FIG. 8 exhibiting a fourth step of the process of storing the card in the stacker.

Figure 14:
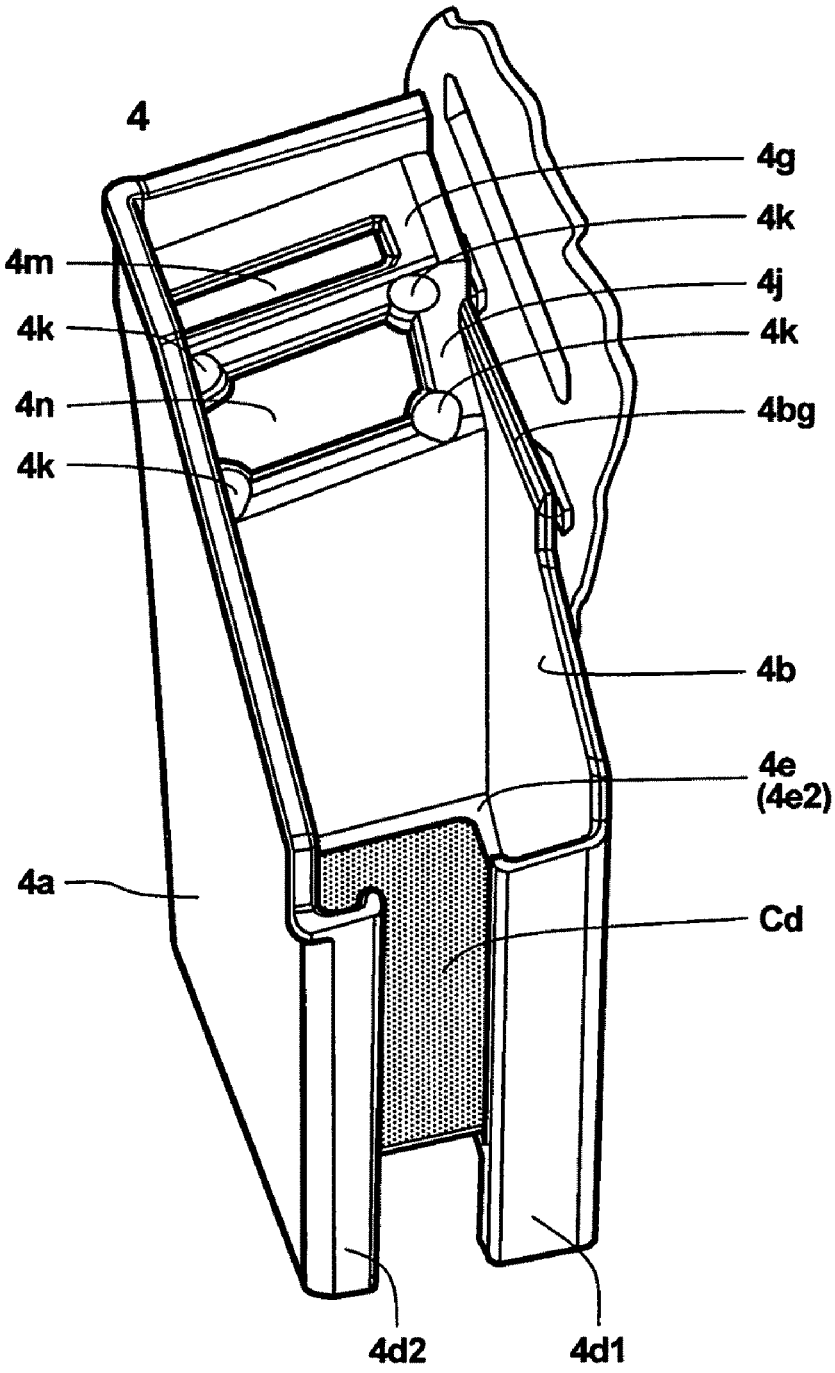
FIG. 14 is a detailed perspective view of the stacker shown in FIG. 8 exhibiting a fifth step of the process of storing the card in the stacker.

FIG. 14 is a detailed perspective view of the stacker shown in FIG. 8 exhibiting a fifth step of the process of storing the card in the stacker.

Figure 15:
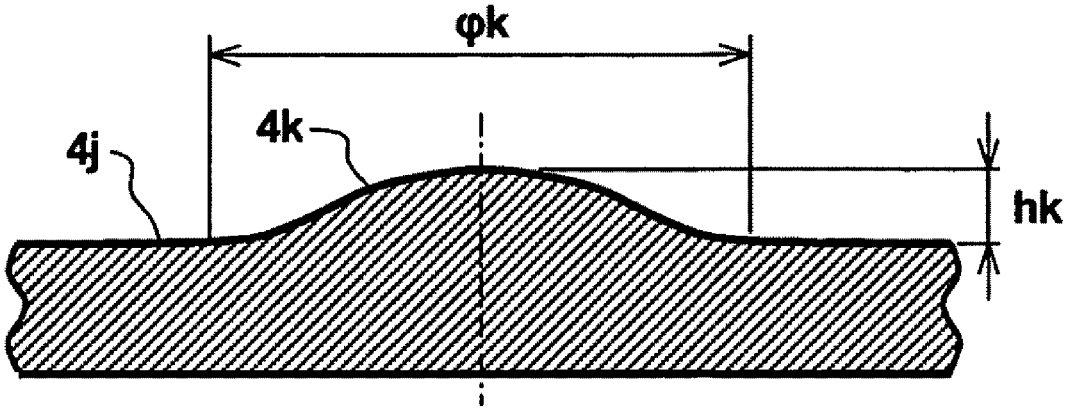
FIG. 15 is an explanatory cross sectional view of a major part of the stacker shown in FIG. 8

FIG. 15 is an explanatory cross sectional view of a major part of the stacker shown in FIG. 8

Figure 16:
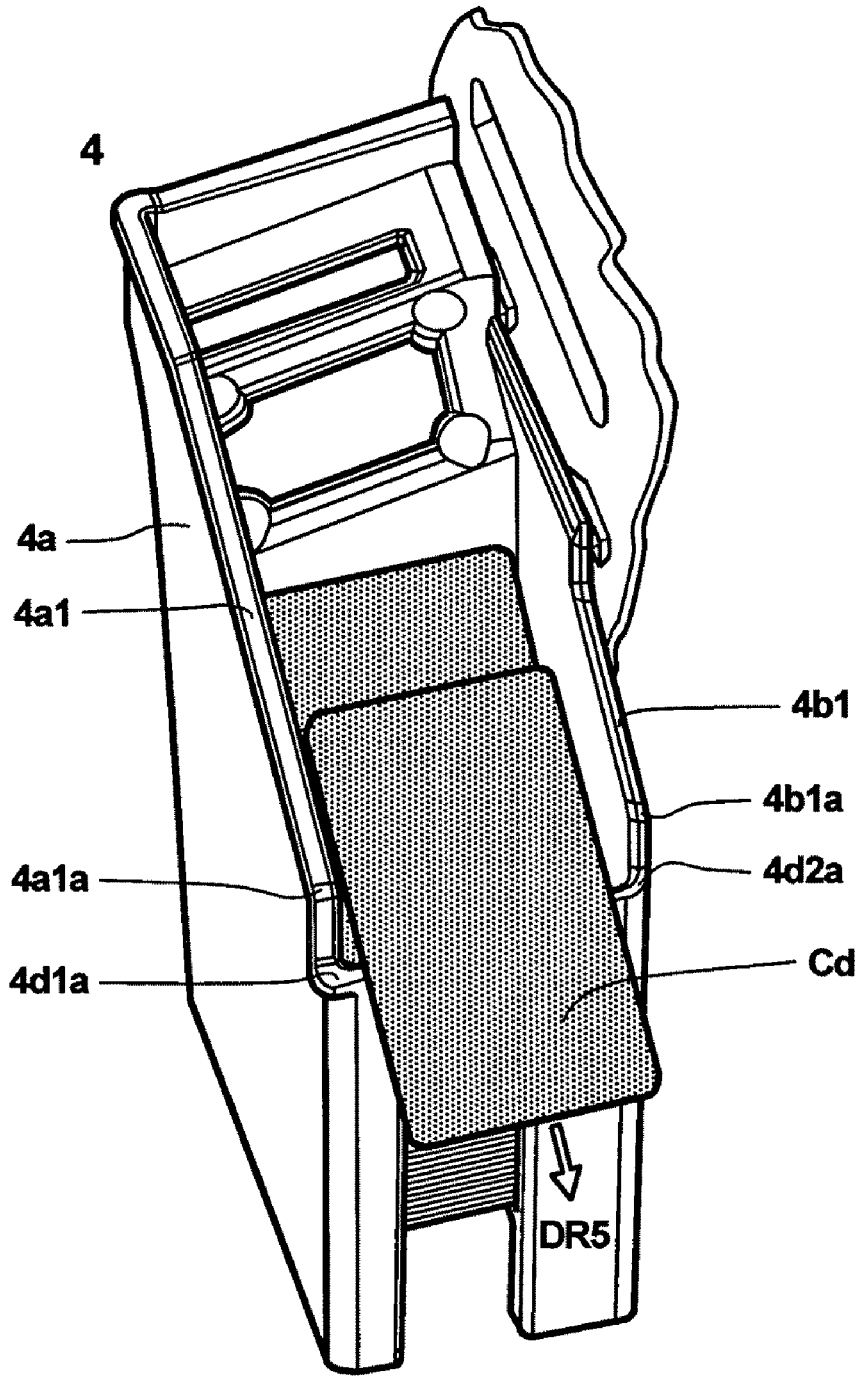
FIG. 16 is an explanatory perspective view of the stacker shown in FIG. 8 exhibiting reaction of the stacker when excessive number of cards are stored in the stacker in piles.
Figure 17:
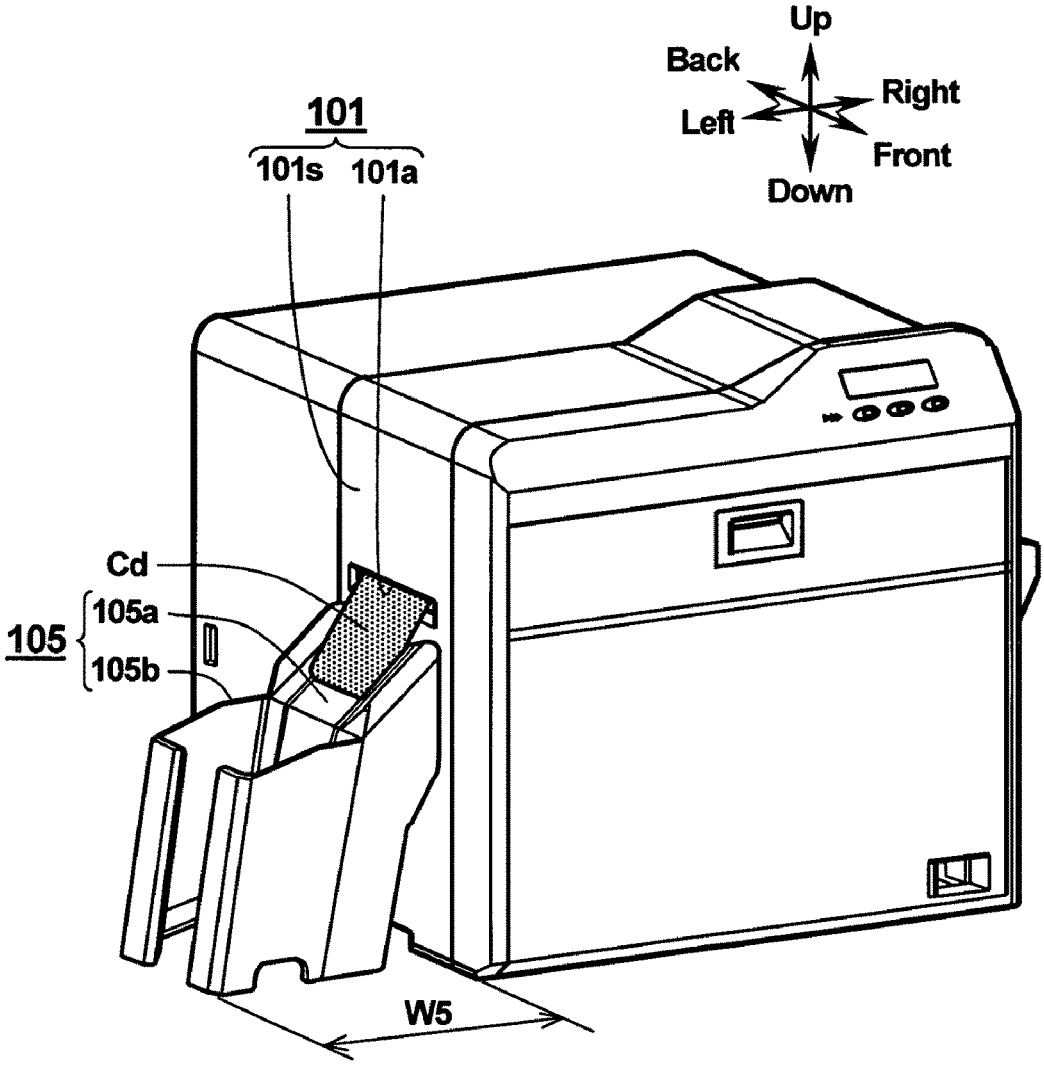
FIG. 17 Prior Art
FIG. 17 is a perspective view of a stacker and a card processing apparatus equipped with the stacker according to the prior art.

FIG. 16 is an explanatory perspective view of the stacker shown in FIG. 8 exhibiting reaction of the stacker when excessive number of cards are stored in the stacker in piles.

In FIG. 8, a stacker 4 contains a card as goods to be stowed. On the other hand, a card processing apparatus 1 is a card printer for conducting a printing process with respect to a card, and then the printed card is ejected from the card processing apparatus 1 through a card carrying out slot 1*a* into the stacker 4.

Further, the stacker 4 having a width of W3 is composed of a left wall section 4*a*, a right wall section 4*b*, a back wall section 4*c*, a pair of front walls 4*d*1 and 4*d*2 and a bottom wall section 4*e*.

Furthermore, directions; upward (Up), downward (Down), leftward (Left), rightward (Right), frontward (Front) and backward (Back) are designated as a matter of practical convenience in FIGS. 8 and 9.

In addition thereto, the directions; Up, Down, Left, Right, Front and back are also applied for each drawing of FIGS. 10-14 and 16 although the directions are not shown in respective drawings.

The card processing apparatus 1 is provided with the card carrying out slot 1*a* for ejecting a card that is disposed on the left sidewall 1*s* of the main body 1*h* in a slightly higher position than middle. A center of the card carrying out slot 1*a* is disposed in a backward side of the left sidewall 1*s* by the distance of D1 from the front panel 1*f* of the card processing apparatus 1.

The stacker 4 is installed in the left side of the card processing apparatus 1.

Further, the stacker 4 is linked to the left sidewall 1*s* of the card processing apparatus 1 and integrated with the card processing apparatus 1 by a not shown linking device.

Furthermore, as shown in FIG. 8, a total width of the card processing apparatus 1 equipped with the stacker 4 is W4.

A card Cd used in the second embodiment is also formed in a rectangular shape having each pair of the longitudinal side Cdn and the lateral side Cdm as shown in FIG. 2, wherein a longitudinal length and a lateral length are defined as Lcn and Lcm respectively.

The card processing apparatus 1 conducts a process such as printing with respect to a card Cd, and then ejects the processed card Cd with heading one longitudinal side Cdn in a first ejecting direction shown by an arrow DR1 through the card carrying out slot 1*a*.

As shown in FIG. 9, the stacker 4 is provided with a plurality of wall sections that extends vertically and formed in approximately a box shape that enables to contain goods to be stowed in a space S4 surrounded by each wall section.

The stacker 4 is formed by the injection molding method of resin, for example. A typical material of resin is an acrylic resin. Particularly, in case the stacker 4 is formed transparently by using a polymethylmethacrylate (PMMA) resin, its appearance is excellent.

More specifically, as shown in FIG. 9, the stacker 4 is formed by the left wall section 4*a* and the right wall section 4*b*, which confront with each other as a pair of sidewalls and extend vertically, the back wall section 4*c*, which connects the left wall section 4*a* to the right wall section 4*b* on the back side of the stacker 4, the pair of front walls 4*d*1 and 4*d*2, which extend in a direction of approaching each other on each front side of the left wall section 4*a* and the right wall section 4*b*, and the bottom wall section 4*e*, which is a bottom plate connected to each of the wall sections 4*a*, 4*b*, 4*c*, 4*d*1, and 4*d*2. A top surface 4*e*2 of the bottom wall section 4*e* is slanted such that its front side is lowered with respect to its back side.

A distance between the left and right wall sections 4*a* and 4*b* is set to be slightly larger than the lateral length Lcm of the card Cd to be contained.

A slit 4*f* is formed between the pair of front wall sections 4*d*1 and 4*d*2. A cutout section 4*e*1 having an opening width corresponding to the slit 4*f* is formed on the bottom wall section 4*e*. The cutout section 4*e*1 is a cutout for inserting a fingertip under piled cards Cd when taking out the piled cards Cd contained in the space S4 of the stacker 4 in piles by hand.

Each wall section of the left 4*a*, the right 4*b*, the back 4*c*, the pair of front 4*d*1 and 4*d*2, and the bottom 4*e* forms a containing section 4*s*.

Further, the space S4 or the containing section 4*s* surrounded by the wall sections 4*a*, 4*b*, 4*c*, 4*d*1, 4*d*2 and 4*e* is a containing space for containing a plurality of cards Cd by stacking the cards on the bottom wall section 4*e*.

A top end section 4*a*1 of the let wall section 4*a* is formed so as to be gradually slanted such that a front portion of the top end section 4*a*1 is lower than a back portion. An angle of gradient of the top end section 4*a*1 is set to be approximately the same as an angle βe of gradient of the bottom wall section 4*e*.

On the other hand, a top end section 4*b*1 of the right wall section 4*b* is provided with an ejection guiding section 4*bg* having a length L4 formed horizontally. The length L4 is set to be slightly shorter than the longitudinal length Lcn of the card Cd.

Further, a front end portion of the top end section 4*b*1 of the right wall section 4*b* is formed so as to be gradually slanted such that an angle of gradient of the top end section 4*b*1 is set to be approximately the same as the angle βe of gradient of the bottom wall section 4*e*.

Furthermore, a height of the front end portion of the top end section 4*b*1 is the same as a front end portion of the top end section 4*a*1 of the left wall section 4*a*.

A slanted surface section 4*h* is provided on an upper side of the back wall section 4*c*. The slanted surface section 4*h* is provided with a slanted supporting section 4*g* and a drop guiding section 4*j*.

More specifically, the back wall section 4*c* is provided with a base section 4*c*1 that confronts with the pair of front walls 4*d*1 and 4*d*2, the slanted supporting section 4*g* having a first top surface 4*gu* that slants so as to decline in accordance with a direction from right to left along the first ejecting direction DR1 and the drop guiding section 4*j* having a second top surface 4*ju* that slants so as to decline in accordance with a direction from right to left along the first ejecting direction DR1 and also slants so as to decline in accordance with a direction from back to front along a second ejecting direction DR2, which intersects with the first ejecting direction DR1 at right angles.

Further, a front side edge of the second top surface 4*ju* is connected to a top end portion of the base section 4*c*1 and a front side edge of the first top surface 4*gu* is connected to a back side edge of the second top surface 4*ju* respectively.

Furthermore, a right side edge of the first top surface 4*gu* is a highest edge line 4*g*1.

A width L6 in a front-back direction of the slanted supporting section 4*g* is set to be smaller than a half of the longitudinal length Lcn of the card Cd.

It is defined hereupon that a first angle of gradient of the slanted supporting section 4*g* in the direction from right to left is β1, a second angle of gradient of the drop guiding section 4*j* in the direction from right to left is β2 and a third angle of gradient of the drop guiding section 4*j* in the direction from back to front is β3. Under the above-mentioned definition, it is desirable that "β1=β2".

Further, it is also desirable that the third angle β3 is the largest of the angles β1-β3.

More specifically, it is defined that "β1=β2=10 to 20 degrees" and "β3=20 to 40 degrees".

A slanting direction of the drop guiding section 4*j* is an arrow "V" direction shown in FIG. 9. In other words, the second top surface 4*ju* of the drop guiding section 4*j* is slanted such that a back right side of the second top surface 4*ju* is the highest and a front left side is the lowest.

In FIG. 9, a distance L5 between a right back end point P4 of the slanted supporting section 4*g* and a front end point P5 of the ejection guiding section 4*bg* is set to be approximately the same as a width of the card carrying out slot 1*a* of the card processing apparatus 1.

The stacker 4 is installed on the card processing apparatus 1 such that a range from the right back end portion P4 to the front end portion P52 is disposed right under the card carrying out slot 1*a*.

As shown in FIG. 9, the slanted supporting section 4*g* and the drop guiding section 4*j* is formed with opening sections 4*m* and 4*n* respectively.

As shown in FIGS. 9 and 10, the drop guiding section 4*j* is provided with four protruded sections 4*k* on four corners of the opening section 4*n* respectively. The protruded section 4*k* is formed in a smoothly curved surface and slightly raised from the surface of the second top surface 4*ju*.

The protruded sections 4*k* and the opening sections 4*m* and 4*n* will be detailed later.

In reference to FIGS. 10-14, a process of storing a card Cd in the stacker 4 is described in detail next.

As shown in FIG. 8, the right wall section 4*b* of the stacker 4 is installed on the left sidewall 1 s of the card processing apparatus 1. In this condition, the range from the right back end portion P4 to the front end portion P5 including the ejection guide section 4*gh* is disposed right under the card carrying out slot 1*a*.

FIG. 10 shows an intermediate state of a card Cd ejected from the card carrying out slot 1*a*. When the card Cd is being carried out from the card carrying out slot 1*a*, the card Cd is moved in the first ejecting direction DR1 with heading the longitudinal side Cdnt while the bottom side of the card Cd is supported by the highest edge line 4*g*1 of the slanted supporting section 4*g* and the ejection guiding section 4*bg*.

FIG. 11 shows a second state of the card Cd of which the longitudinal side Cdne on the tail end side passes over the ejection guide section 4*bg* after the card Cd is completely ejected from the card carrying out slot 1*a*.

The card Cd moves in the first ejecting direction DR1 under its own inertia when ejected from the card carrying out slot 1*a*. On the other hand, the lateral side Cdmr of the card Cd lands on the slanted supporting section 4*g* when the longitudinal side Cdne on the tail end side of the card Cd passes over the ejection guiding section 4*bg*. Then the longitudinal side Cdnt on the front end side of the card Cd contacts with an inner wall surface 4*a*2 of the left wall section 4*a*.

As mentioned above, the width L6 of the slanted supporting section 4*g* is set to be shorter than a half of the longitudinal length Lcn of the card Cd.

Accordingly, the card Cd never stays on the slanted supporting section 4*g* but turns around an edge line that is an intersection of the slanted supporting section 4*g* and the drop guiding section 4*j* in an arrow DR4 direction shown in FIG. 12 so as to lower the lateral side Cdml of the card Cd.

FIG. 12 shows a third state of the card Cd of which the lateral side Cdmr is above the slanted supporting section 4*g* and the other lateral side Cdml turns in the arrow DR4 direction and is slanted. FIG. 13 shows an intermediate state of the card Cd that is falling down to the bottom wall section 4*e* in an arrow DR3 direction. In FIG. 12, a bottom surface of the card Cd that is slanted as mentioned above contacts with the drop guiding section 4*j* and slides down on the second slanted surface 4*ju* of the drop guiding section 4*j* in the second ejecting direction DR2. Then, as shown in FIG. 13, the card Cd falls down to the bottom wall section 4*e* in the arrow DR3 direction by the gravitational force. When the card Cd slides down on the drop guiding section 4*j*, the bottom surface of the card Cd point-contacts mainly with the four protruded sections 4*k*.

A part of the left wall section 4*a* contacting with the longitudinal side Cdnt of the card Cd and its neighboring area is formed so as to be extended within a plain that intersects with the first ejecting direction DR1 approximately at right angles. Therefore, an ejecting direction of the card Cd is changed from the arrow DR1 direction to the arrow DR2 direction. In other words, by the above-mentioned configuration of the slanted supporting section 4*g*, the drop guiding section 4*j* and the left wall section 4*a*, the ejecting direction of the card Cd is turned counterclockwise by 90 degrees viewing from up above the stacker 4.

FIG. 14 is a final state of the card Cd landed on the bottom wall section 4*e*. In FIG. 14, the card Cd is a first card to be stacked on the top surface 4*e*2 of the bottom wall surface 4*e* in the containing section 4*s*. Cards succeeding the first one are sequentially stacked on a previously stacked card through the above-mentioned containing process shown in FIGS. 10-14.

In FIG. 13, a posture of the card Cd while sliding down in the arrow DR2 direction is such that movement of the card Cd from the card carrying out slot 1*a* is restricted by the inner surface 4*a*2 of the left wall section 4*a* and the position of the longitudinal side Cdnt to be a head of the card Cd when ejected from the card carrying out slot 1*a* is also determined by the inner surface 4*a*2 of the left wall section 4*a* as shown in FIG. 12.

Further, with respect to a direction of the gravitational force, the lateral side Cdmr on the back side of the card Cd is supported by the slanted supporting section 4*g* and then slides down on the drop guiding section 4*j* while being supported by the drop guiding section 4*j* when sliding down in the arrow DR2 direction. Therefore, the posture of the card Cd is maintained extremely stable.

Accordingly, the card Cd is never reversed its surface while sliding down into the space S4.

In addition, the card Cd is stacked on the top surface 4e2 of the bottom wall section 4e almost without positional deflection in a left and right direction.

By the above-mentioned configuration of the stacker 4, the ejecting direction of the card Cd is changed from the arrow DR1 direction to the arrow DR2 direction, so that the width W3 of the stacker 4 shown in FIG. 9 enables to be shortened as narrow as a dimension of the lateral length Lcm added with thicknesses of the left and right wall sections 4a and 4b. Therefore the stacker 4 is extremely compact in width.

As a result, the total width W4 of the card processing apparatus 1 equipped with the stacker 4 shown in FIG. 8 is also small in dimension.

Accordingly, the card processing apparatus 1 equipped with the stacker 4 enables to be installed even in a narrower space than ever.

Further, as shown in FIG. 8, a position of outer surfaces of the front wall sections 4d1 and 4d2 toward the front side is designated so as to be approximately the same position as the front surface 1f of the card processing apparatus 1.

Furthermore, in FIG. 9, a distance L7 between the back wall section 4c and the front wall sections 4d1 and 4d2 is set to be slightly larger than the longitudinal length Len of the card Cd.

By the above-mentioned configuration of the stacker 4, stacked cards Cd contained in the stacker 4 enable to be taken out from the front side, and resulting in extremely easy handling of the stacked cards Cd even though the card carrying out slot 1a is set far back from the front surface 1f of the card processing apparatus 1 by the distance D1 as shown in FIG. 8.

Further, positional deflection of the cards Cd stacked in the containing section 4s is restricted excellently.

Furthermore, in FIG. 9, the angle βe of gradient of the top surface 4e2 on which the card Cd is stacked, of the bottom wall section 4e in a front-back direction is preferable to be the same angle as the third angle β3 of gradient of the drop guiding section 4j.

More, an angle of gradient of the top surface 4e2 of the bottom wall section 4e in the left and right direction is also preferable to be the same angle as the second angle β2 of gradient of the drop guiding section 4j.

Moreover, the top surface 4e2 of the bottom wall section 4e is desirable to be formed in parallel with the top surface 4ju of the drop guiding section 4j.

By the above-mentioned configuration of the bottom wall section 4e, a posture of the card Cd landed on the top surface 4e2 of the bottom wall section 4e or stacked on a card previously landed on the top surface 4e2 approximately coincides with the posture of the card Cd at the beginning of falling down, and resulting in suppressing bounce of the card Cd when landed on the top surface 4e2.

Accordingly, a posture of the card Cd stored in the containing section 4s is always maintained in stable condition and the cards Cd enable to be contained in order.

In addition, the card Cd enables to be securely prevented from accidental error of containing more.

As mentioned above, the stacker 4 is formed with the protruded sections 4k and the opening sections 4m and 4n shown in FIG. 14. Locations, dimensions and shapes of these sections are designated so as not to prevent the card Cd moving on the slanted supporting section 4g and the drop guiding section 4j from moving freely.

FIG. 15 is a typical cross sectional view of the protruded section 4k. The protruded section 4k is formed in a hill shape that gradually rises from a top surface of the drop guiding section 4j so as to guide a front end portion of a moving card Cd to be running on the protruded section 4k without sticking.

Dimensions of the protruded section 4k, for example, are such that a diameter φk of a rising point is 10 mm and a protruded height hk is 2 mm.

Further, the protruded section 4k and the opening sections 4m and 4n are formed so as to minimize a contacting area of the card Cd with the slant supporting section 4g and the drop guiding section 4j.

Furthermore, in some card processing apparatus 1, a card Cd is charged by static electricity generated in the apparatus. In case the charged card Cd is placed on a flat surface formed by resin or plastics, the charged card Cd is possibly stuck on the flat surface by electrostatic force.

In this regard, by providing the protruded section 4k and the opening sections 4m and 4n, the surface of the card Cd hardly contacts with the stacker 4, so that the card Cd is prevented form sticking on a flat surface by electrostatic charge.

Further, in case the card processing apparatus 1 is equipped with a function of removing electricity, it seldom occurs that a card Cd sticks on a flat surface of the stacker 4 without providing the protruded section 4k and the opening sections 4m and 4n. However, it is preferable for a stacker to be formed with the protruded section 4k and the opening sections 4m and 4n for the purpose of increasing the versatility of the stacker without selecting a card processing apparatus to be equipped with the stacker.

Furthermore, in the second embodiment of the resent invention, the protruded section 4k and the opening sections 4m and 4n are provided on the stacker 4. However, it should be understood that the protruded section 4k and the opening sections 4m and 4n enable to be provided on the slanted surface section 2h of the stacker 2 according to the first embodiment of the present invention.

FIG. 16 shows a card Cd that overflows from the containing section 4s of the stacker 4. As shown in FIG. 16, the stacker 4 is formed such that top end sections 4d1a and 4d2a of the front wall sections 4d1 and 4d2 are disposed in lower positions than front corner sections 4a1a and 4b1a of top edge sections 4a1 and 4b1 of the left and right sidewall sections 4a and 4b.

Further, positions of the top end sections 4d1a and 4d2a of the front wall sections 4d1 and 4d2 are configured such that an excessive card Cd, which is ejected from the card processing apparatus 1 by exceeding a prescribed quantity enabling to be contained in the stacker 4, falls down in front of the stacker 4 in an arrow DR5 direction shown in FIG. 16 after getting over the top end sections 4d1a and 4d2a. In this regard, FIG. 16 shows an intermediate state of the card Cd that crosses over the top end sections 4d1a and 4d2a when stacked cards on the top surface 4e2 of the bottom wall section 4e exceed the prescribed quantity.

Accordingly, it never happens that excessive quantities of cards Cd are stacked as high as reaching to the card carrying out slot 1a, and obstruct ejection of the card Cd from the card processing apparatus 1.

As mentioned above, the stacker according to the present invention achieves an excellent effect such that the stacker enables to contain goods to be stowed by stacking the goods without reversing its surface and also is compact in dimensions.

Further, by the card processing apparatus equipped with the stacker according to the present invention, a plurality of cards are contained in the stacker by stacking the cards without mixing up a card of which surface is reversed.

Furthermore, the card processing apparatus equipped with the stacker according to the present invention achieves an excellent effect such that an amount of bulge from an outer surface of the card processing apparatus is minimized, and resulting in being compact totally.

While the invention has been described above with reference to a specific embodiment thereof, it is apparent that many changes, modifications and variations in configuration, materials and the arrangement of equipment and devices can be made without departing from the invention concept disclosed herein.

For instance, it should be understood that the stacker 2 or 4 enables to be separated from the card processing apparatus 1 or enables to be built into the card processing apparatus 1.

Further, it should be understood that a card Cd ejected from the card carrying out slot 1*a* of the card processing apparatus 1 is acceptable in any posture either leading a longitudinal side of a card Cd at the head or leading a lateral side of the card Cd at the head.

Furthermore, it should be understood that a card Cd is not restricted to be a rectangular shape. Any shape is acceptable. A card in any shape is changed its moving direction by approximately 90 degrees and contained in the containing section 2*s* or 4*s* of the stacker 2 or 4 while maintaining its posture when ejected from the card carrying out slot 1*a* of the card processing apparatus 1.

More, the protruded section 4*k* and the opening sections 4*m* and 4*n* provided on the stacker 4 are devices for minimizing a contacting area of a card Cd with the stacker 4. It should be understood that a recessed section dented from a surface enables to be provided as a device for minimizing a contacting area and also the device for minimizing a contacting area enables to be formed on the stacker 2.

Moreover, goods to be stowed are not restricted to be a card. It should be understood that a plate-like body of which thickness is relatively thick in proportion to its outer dimensions enables to be applied for goods to be stowed.

In addition thereto, it will be apparent to those skilled in the art that various modifications and variations could be made in the stacker and the card processing apparatus equipped with the stacker in the present invention without departing from the scope of the invention.

What is claimed is:

1. A stacker comprising:

a bottom plate;

a containing section for storing a plurality of cards by stacking the plurality of cards on the bottom plate; and a guiding section for guiding each of the plurality of cards entering into the containing section from an external section provided above the bottom plate, the guiding section further comprising:

a sidewall for restricting movement of an entering card by guiding a head of the entering card to contact with the sidewall when the card entering into the stacker in a first moving direction while the card maintaining approximately a horizontal posture; and a slanted section for supporting a bottom surface of either one of left and right sides of the card and for slanting another side of the card to be lowered with respect to the first moving direction of the card while the movement of the card is restricted by the sidewall, wherein the card slanted by the slanted section moves in a second moving direction intersecting with the first moving direction at approximately a right angle by the gravitational force and the card is guided into the containing section, and wherein the card guided into the containing section is stacked on the bottom plate.

2. The stacker claimed in claim 1, wherein the slanted section is composed of a first slanted surface that declines in the second moving direction by a first prescribed angle of gradient, and wherein the bottom plate is composed of a second slanted surface that declines in the second moving direction by the first prescribed angle of gradient, and further wherein the card is stacked on the second slanted surface of the bottom plate.

3. The stacker claimed in claim 1, wherein the containing section is composed of a positioning wall section for positioning the card stacked on the bottom plate while interlinking with the bottom plate.

4. The stacker claimed in claim 2, wherein the first slanted surface declines in the first moving direction by a second prescribed angle of gradient.

5. The stacker claimed in claim 2, wherein the first slanted surface is composed of a means for minimizing a contacting area of the card with the slanted section in comparison with a case of the slanted section of which total surface is flat.

6. The stacker claimed in claim 5, wherein the means for minimizing a contacting area of the card with the first or second slanted section is formed in any one of an opening section, a recessed section and a protruded section.

7. A stacker comprising:

a bottom plate;

a containing section for storing a plurality of cards by stacking the plurality of cards on the bottom plate; and a guiding section for guiding each of the plurality of cards entering into the containing section from an external section provided above the bottom plate, the guiding section further comprising:

a sidewall for restricting movement of an entering card by guiding a head of the entering card to contact with the sidewall when the card entering into the stacker in a first moving direction while the card maintaining approximately a horizontal posture;

a first slanted section for supporting a bottom surface of either one of left and right sides of the card and for slanting another side of the card to be lowered with respect to the first moving direction of the card while the movement of the card is restricted by the sidewall; and a second slanted section for guiding the card slanted by the first slanted section to move in a second moving direction intersecting with the first moving direction at approximately a right angle by the gravitational force while the bottom surface of the card contacts with the first slanted section, wherein the card is guided into the containing section through the second slanted section and stacked on the bottom plate.

8. The stacker claimed in claim 7, wherein the first slanted section is composed of a first slanted surface that declines in the first moving direction by a first prescribed angle of gradient.

9. The stacker claimed in claim 7, wherein the second slanted section is composed of a second slanted surface that declines in the second moving direction by a second prescribed angle of gradient, and wherein the bottom plate is composed of a third slanted surface that declines in the second moving direction by the second prescribed angle of gradient, and further wherein the card is stacked on the third slanted surface of the bottom plate.

10. The stacker claimed in claim 7, wherein the containing section is composed of a positioning wall section for positioning the card stacked on the bottom plate while interlinking with the bottom plate.

11. The stacker claimed in claim 9, wherein the first or second slanted surface is composed of a means for minimizing a contacting area of the card with the first or second slanted section in comparison with a case of the first or second slanted section of which total surface is flat.

12. The stacker claimed in claim 11, wherein the means for minimizing a contacting area of the card with the first or second slanted section is formed in any one of an opening section, a recessed section and a protruded section.

13. A card processing apparatus for conducting an additional process to a card, the card processing apparatus comprising:

a main body;

a card carrying out slot provided on one sidewall of the main body for ejecting a card outside in a first moving direction; and a stacker having a containing section for storing the card sequentially ejected from the card carrying out slot by stacking the card, wherein the stacker further comprises a guiding section for moving the card ejected from the card carrying out slot in a second moving direction intersecting with the first moving direction at approximately a right angle by the gravitational force and for guiding the card into the containing section.

14. The card processing apparatus claimed in claim 13, wherein the one sidewall is either a left sidewall or a right sidewall, and wherein the second moving direction is a direction from a back side to a front side of the main body.

* * * * *